US005565640A

United States Patent [19]

Hasebe

[11] Patent Number: 5,565,640

[45] Date of Patent: Oct. 15, 1996

[54] AUTOMATIC PERFORMANCE DEVICE CAPABLE OF STARTING AN AUTOMATIC PERFORMANCE IN RESPONSE TO A TRIGGER SIGNAL

[75] Inventor: Kiyoshi Hasebe, Hamamatsu, Japan

[73] Assignee: Yamaha Corporation, Shizuoka-ken, Japan

[21] Appl. No.: 589,788

[22] Filed: Jan. 22, 1996

Related U.S. Application Data

[63] Continuation of Ser. No. 210,158, Mar. 17, 1994, abandoned.

[30] Foreign Application Priority Data

Mar. 19, 1993 [JP] Japan ..... 5-60710

[51] Int. Cl.[6] ..... G10H 1/40; G10H 7/00

[52] U.S. Cl. ..... 84/612; 84/DIG. 12

[58] Field of Search ..... 84/609–614, 634–638, 84/DIG. 12

[56] References Cited

U.S. PATENT DOCUMENTS

| | | | |
|---|---|---|---|
| 4,448,104 | 5/1984 | Hoshii . | |
| 5,200,566 | 4/1993 | Shimaya | 84/609 |
| 5,326,930 | 7/1994 | Hayakawa | 84/612 X |

*Primary Examiner*—Stanley J. Witkowski
*Attorney, Agent, or Firm*—Graham & James LLP

[57] ABSTRACT

An automatic performance device stores automatic performance data corresponding to a plurality of parts in music in a storage device. A first portion of the performance data corresponding to at least one of the plurality of parts in music is read out from the storage device in response to a trigger. A second portion of the performance data corresponding to other parts than the at least one of the plurality of parts in music is read out from the storage device. A point of the storage device from which the first portion of the performance data corresponding to the at least one of the plurality of parts in music is to be read out is shifted when no trigger has been generated.

25 Claims, 21 Drawing Sheets

FIG.18

| PERFORMANCE DATA / PERFORMANCE PART(TRACK) | AUTOMATIC PERFORMANCE DATA | | | | | |
|---|---|---|---|---|---|---|
| PIANO | ED | DD | ED | ED | DD | ..... |
| BASS | ED | DD | ED | DD | ..... | |
| DRUM | ED | DD | ED | ..... | | |
| TRUMPET | ED | DD | ..... | | | |

FIG.19

MEASURE SIZE TABLE

| 383 | 383 | 383 | ..... | 191 | 383 | .... |
|---|---|---|---|---|---|---|

MEASURE NUMBER → 1 2 3

DATA FORMAT

| | | | | | | | | | | | |
|---|---|---|---|---|---|---|---|---|---|---|---|
| Ph1 | D1 | NR | D2 | Ph2 | D3 | NR | D4 | Ph3 | D5 | NR | ..... |

PHRASE DATA FOR TRIGGER-DRIVEN PERFORMANCE

| |
|---|
| AUTOMATIC PERFORMANCE DATA OF Ph1 |
| AUTOMATIC PERFORMANCE DATA OF Ph2 |
| AUTOMATIC PERFORMANCE DATA OF Ph3 |
| AUTOMATIC PERFORMANCE DATA OF Ph4 |
| ⋮ |

AUTOMATIC PERFORMANCE DEVICE CAPABLE OF STARTING AN AUTOMATIC PERFORMANCE IN RESPONSE TO A TRIGGER SIGNAL

This is a continuation of application Ser. No. 08/210,158 filed on Mar. 17, 1994 now abandoned.

BACKGROUND OF THE INVENTION

1. Field of the Invention

This invention relates to an automatic performance device for automatic performance of music, which sequentially reads out performance data stored beforehand and generates musical tones based on the read performance data.

2. Prior Art

Conventionally, various automatic performance devices have been developed. In one conventional automatic performance device, performance data of musical tones to be produced are stored beforehand in a memory device, and then sequentially read out in response to triggers to reproduce musical tones. In processing the performance data, the read addresses of the performance data stored in the memory means are sequentially shifted backward one by one whenever a trigger is generated.

A trigger is generated e.g. by depressing a particular key of a keyboard to which the triggering action is assigned. The duration of a musical tone generated is equal to the duration of depression of the particular key.

This conventional automatic performance device enables the player to perform merely by depressing the particular key without specifying accurate pitches of musical tones to be produced. During performance, the tempo of a tune and the duration of each tone can be freely controlled by the player to his taste. Further, the player can enjoy concert by using this type of automatic performance with a so-called ordinary automatic performance, which entirely dispenses with operation of the player.

However, the above conventional automatic performance device has the disadvantage that once the player mistimes triggering, the performance is interrupted and cannot be completed, and the player cannot start performance of a piece of music at an intermediate portion thereof.

Further, unless the player remembers the duration of each note, that is, unless he knows the piece of music accurately, it is impossible for him to accurately perform.

Further, in the conventional automatic performance device, the triggering action by the player can only correspond to generation of a single tone, and hence it is impossible to carry out automatic performance of chords or multiple tones by simple manipulation of the device.

SUMMARY OF THE INVENTION

It is the object of the invention to provide an automatic performance device which enables the player to automatically perform based on single tones as well as on multiple tones by simple manipulation thereof, and restart the performance even if the player mistimes triggering, allowing him to start performance of a piece of music at any intermediate portion thereof.

To attain the above object, the invention provides an automatic performance device comprising:

storage means storing automatic performance data corresponding to a plurality of parts in music;

trigger-generating means for generating a trigger;

first readout means responsive to generation of the trigger, for reading out a first portion of the performance data corresponding to at least one of the plurality of parts in music from the storage means;

second readout means for reading out a second portion of the performance data corresponding to other parts than the at least one of the plurality of parts in music from the storage means; and readout point-shifting means for shifting a point of the storage means from which the first portion of the performance data corresponding to the at least one of the plurality of parts in music is to be read out, when no trigger has been generated.

According to the automatic performance device having the above construction, when no trigger has been generated, the point of readout of data for trigger-driven performance is shifted to a proper point, which enables the trigger-driven performance to be given in a manner corresponding to the progress of performance on the normal tracks, permitting a player to resume his performance from any intermediate point of a piece of music.

Preferably, the automatic performance device includes trigger-accepting time period-setting means for setting a time period for accepting the trigger generated by the trigger-generating means, and trigger-rejecting time period-setting means for setting a time period for rejecting the trigger.

The provision of the trigger-accepting time period and the trigger-rejecting time period prevents the performance as a whole given by the device from being largely disturbed or deviated from a proper one. Further, within the trigger-accepting time period, the automatic performance is given in response to timing of triggering by the player, which makes him feel actually giving his performance, and permits him to improve his skill.

In one preferred form, the trigger-accepting time period-setting means sets the trigger-accepting time period in a manner corresponding to an end of each of predetermined sections of a piece of music for performance, and the trigger-rejecting time period-setting means sets the trigger-rejecting time period outside the trigger-accepting period.

In another preferred form, the trigger-accepting time period-setting means sets duration of a musical tone corresponding to each note and preceding timing of readout by the second readout means of the second portion of the performance data from the storage means, by a predetermined time period, to the trigger-accepting time period.

Preferably, the automatic performance device includes tone generating means for generating a musical tone based on the first portion of the performance data read out by the first readout means, tone generation-terminating means for terminating the generation of the musical tone, when the trigger is generated while the tone generating means is generating the musical tone within the trigger accepting time period, and tone generation control means for shifting the point of the storage means from which the first portion of the performance data corresponding to the at least one of the plurality of parts in music is to be read out, to a predetermined point, and thereafter causing the first readout means to read out the first portion of the performance data from the storage means.

Preferably, the storage means comprises a plurality of tracks storing respective portions of the automatic performance data corresponding to the plurality of parts in music, and the device includes selecting means for selecting the first portion of the performance data to be readout by the first readout means in response to the trigger, by selecting at least one of the tracks, which stores the first portion of the performance data.

Preferably, the readout point-shifting means operates upon starting of the trigger accepting time period to shift the point of the storage means from which the at least one of the plurality of parts in music is to be readout, to a predetermined point.

Further, preferably, the readout point-shifting means comprises first means for determining a first value indicative of a time period over which automatic performance based on the first portion of the performance data has been given in response to the trigger, second means for determining a second value indicative of a time interval from a point of progress of the automatic performance given in response to the trigger in each of the predetermined sections of the piece of music to a first event data within a succeeding one of the predetermined sections of the piece of music, and shifting point-determining means for comparing a sum of the first value and the second value with a size of the each of the predetermined sections, to determine a predetermined point to which the point of the storage means is to be shifted.

In another preferred form, the storage means includes at least one track exclusively storing the first portion of the performance data corresponding to the at least one of the plurality of parts in music to be read out by the first readout means from the storage means.

In this form of the invention, it is preferred that the first portion of the performance data exclusively stored in the at least one track comprises a sequence of repetition of a cycle of a performance data portion, a first duration data portion, a data readout inhibition portion, and a second duration data portion.

Further preferably, the readout point-shifting means shifts the point of the storage means from which the first portion of the performance data corresponding to the at least one of the plurality of parts in music is to be readout, to a predetermined point, based on the first duration data portion and the second duration data portion.

Preferably, the predetermined sections of the piece of music correspond to measures thereof.

Also preferably, the predetermined sections of the piece of music correspond to phrases thereof.

The above and other objects, features, and advantages of the invention will become more apparent from the ensuing detailed description taken in conjunction with the accompanying drawings.

BRIEF DESCRIPTION OF THE DRAWINGS

FIGS. 3 to 11 show programs for executing various processings carried out by the first embodiment, in which:

FIG. 3 is a flowchart showing a main routine for the operation of the automatic performance device;

FIG. 4 is a flowchart of a subroutine for a timer interruption processing;

FIG. 5 is a flowchart of a subroutine for a panel processing;

FIG. 6 ms a flowchart of a subroutine for a readout-permitting processing;

FIG. 7 is a flowchart of a subroutine for a trigger processing;

FIG. 8 is a flowchart of a subroutine for a pointer-shifting processing;

FIG. 9 is a flowchart of a subroutine for an automatic performance processing;

FIG. 10 is a flowchart of a subroutine for a normal track processing; and

FIG. 11 is a flowchart of a subroutine for a trigger-driven track processing;

FIGS. 14 to 17 show programs for executing various processings carried out by the second embodiment, in which:

FIG. 14 is a flowchart of a subroutine for a timer interruption processing;

FIG. 15 is a flowchart of a subroutine for an automatic performance processing;

FIG. 16 is a flowchart of a subroutine for a trigger-driven track processing; and FIG. 17 is a flowchart of a subroutine for a trigger processing;

FIG. 18 shows a memory map of performance data of the second embodiment stored in a ROM appearing in FIG. 1;

FIG. 19 shows a measure size table composed of the relationship between measure numbers and corresponding numbers of clocks;

FIGS. 23 to 26 show programs for executing various processings carried out by the third embodiment, in which:

FIG. 23 is a flowchart showing a subroutine for an automatic performance processing;

FIG. 24 is a flowchart showing a subroutine for an exclusive trigger-driven track processing;

FIG. 25 is a flowchart showing a subroutine for a phrase automatic performance processing; and FIG. 26 is a flowchart showing a subroutine for a trigger processing.

DETAILED DESCRIPTION

Figure 1:
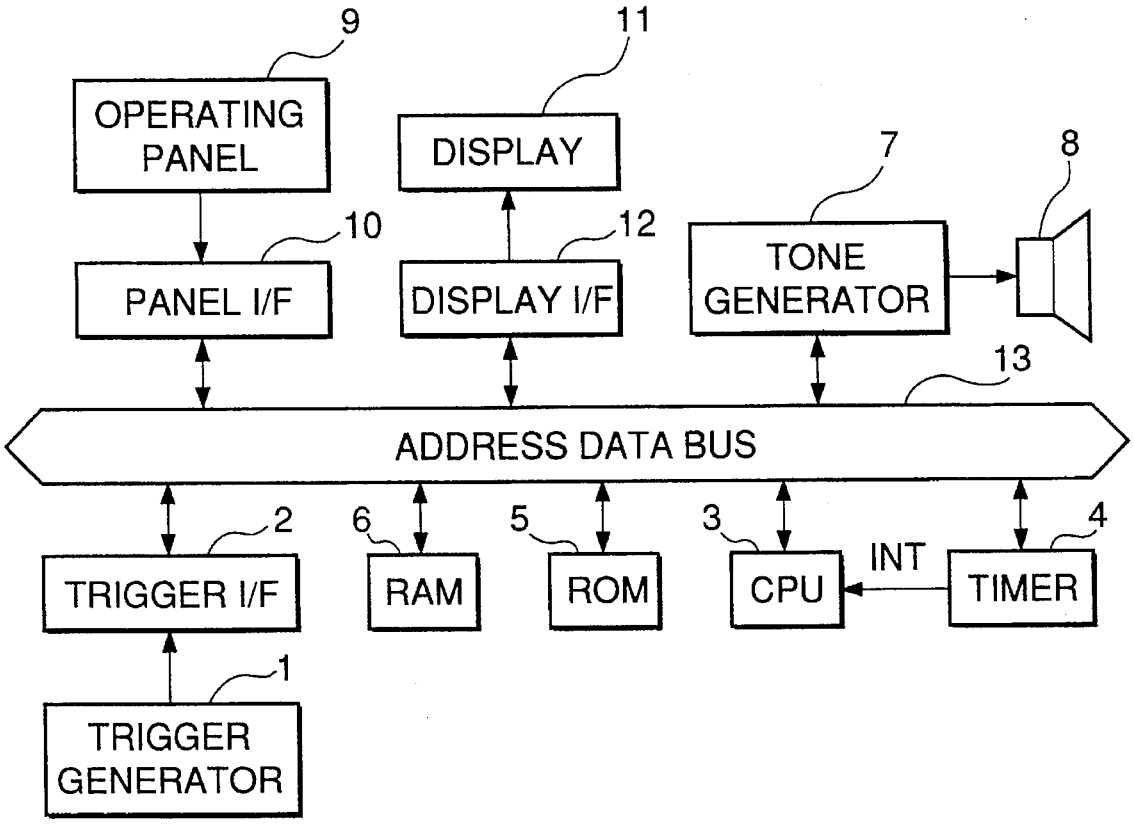
FIG. 1 is a block diagram showing the whole arrangement of an automatic performance device, according to first to three embodiments of the invention.

Next, the invention will be described in detail with reference to drawings showing first to three embodiments thereof. First, operations common to all the embodiments will be described. In these embodiments, musical tones are reproduced on one hand by controlling at least one track (hereinafter referred to as "the trigger-driven track") of a plurality of tracks for automatic performance by triggering action of the player, and on the other hand by subjecting the other tracks (hereinafter referred to as "the normal tracks"), which are not controlled by the triggering action, to known or conventional processing for automatic performance.

The player triggers at timing corresponding to portions of a piece of music at which a trigger should be generated while listening to musical tones performed with the normal tracks. When a trigger is generated, reading-out of a predetermined limited portion of automatic performance data from the trigger-driven track is immediately started, and automatic performance is given based on the data read out. In actuality, the timing of triggering action effected by the player almost always deviates from the timing of triggering required for the proper performance of a piece of music, but musical tones from the trigger-driven track are reproduced with the same tempo as musical tones from the normal tracks, irrespective of the deviation. As a result, the player is liable to suffer from a larger amount of deviation in timing from the proper performance, as he is less skilled in the performance or poorer in rhythmical sense, resulting in a larger gap between performance reproduced from the normal tracks and one from the trigger-driven tracks, that is, a so-called poor performance. On the other hand, even if the player fails to trigger, the starting address from which data should start to be read out for reproduction of a musical tone is shifted as the 30 performance from the normal tracks makes progress, and therefore, even if the player is not skilled enough to continue through the performance, he can return to the performance at any intermediate point of the piece of music since the trigger-driven automatic performance can be given in a manner corresponding to progress made by the normal tracks.

Further, the player can reduce the amount of deviation as he becomes more skilled in playing the music on the automatic performance device so that his performance becomes closer to an original or proper one, to make him a better player. Thus, the player can reflect his skill acquired through practice on the performance.

Next, the first embodiment will be described, in which trigger-driven automatic performance is given, measure by measure. The player triggers at a time point at or near the head of each measure while listening to performance reproduced from the normal tracks. When the automatic performance device recognizes a trigger generated by the player, it starts to read data from the trigger-driven track and stops reading same after data corresponding to one measure has been read out. So long as the triggering regularly occurs at the head of each measure, the above operation is repeatedly carried out without the performance being discontinued. If the player stops triggering in the course of a piece of music, the starting point or address at which data should start to be read out is shifted as the performance based on the normal tracks makes progress. When the player resumes triggering, data starts to be read out from a read address corresponding to the point of progress of performance based on the normal tracks, thereby giving trigger-driven automatic performance. This enables the player to participate in the performance at and after an intermediate point of a piece of music, or resume the performance even after it is discontinued. The first embodiment is suitable for driving a multiple tone-generating automatic performance musical instrument by triggering.

Next, the construction of the automatic performance device according to the first embodiment will be described with reference to FIGS. 1 and 2. FIG. 1 schematically shows the whole arrangement of the automatic performance device according to the first embodiment.

In the figure, reference numeral 1 designates a trigger generator, which generates a trigger for starting reading of performance data. Details of the trigger generator 1 will be described hereinbelow with reference to FIG. 2*a* or FIG. 2*b*. The trigger generated from the trigger generator 1 is detected by a trigger interface (I/F) 2, from which a signal indicative of the detected trigger is delivered via an address data bus 13 to a central processing unit (CPU) 3.

Reference numeral 4 designates a timer for supplying an interrupt signal INT to the CPU 3. Upon receiving the interrupt signal INT, the CPU 3 performs timer interruption processing, described in detail hereinafter. In the present embodiment, the time interval of generation of the interrupt signal INT is changed according to the tempo of the music. For example, the interrupt signal INT is generated 96 times per quarter note, and hence for a 4/4 time, the interrupt signal INT is generated 384 times per measure.

Reference numeral 5 designates a read only memory (ROM) storing programs executed by the CPU 3 and performance data for use in automatic performance. Reference numeral 6 designates a random access memory (RAM) for use as various registers, described hereinafter, and for storing results of calculations. Reference numeral 7 designates a tone generator 7 for generating a musical tone signal under the control of the CPU 3 to deliver it to a sound system 8. The sound system 8 is comprised of a digital-to-analog converter, an amplifier, and loudspeakers, none of which are shown, and is adapted to convert the musical tone signal in digital form into one in analog form, amplify the resulting signal, and then generate a musical tone as a sound signal.

Reference numeral 9 designates an operating panel comprised of various operating elements for setting the tempo of pieces of music, selecting a trigger-driven track, etc. The operative status of each operating element is monitored by a panel interface (I/F) 10, and a signal indicative of the detected operative status of each element is delivered to the CPU 3 via the address data bus 13. Reference numeral 11 designates a display for displaying various indications under the control of the CPU 3 via a display interface (I/F) 12 and the address data bus 13.

The ROM 5 stores automatic performance data as shown in FIG. 18. In the present embodiment, the automatic performance data is stored in four different tracks for storing four kinds of performance data of four parts of piano, bass, drum, and trumpet, respectively. The automatic performance data of each kind is formed by event data ED, and duration data DD indicative of a time interval between each item of the event data ED and the next one. The event data ED comprises key-on data, key-off data, program change data, and control change data. Whenever a time period indicated by an item of the duration data ED elapses, an item of the event data ED is read out to carry out processing depending on the type of event data for giving automatic performance.

Figure 2A:
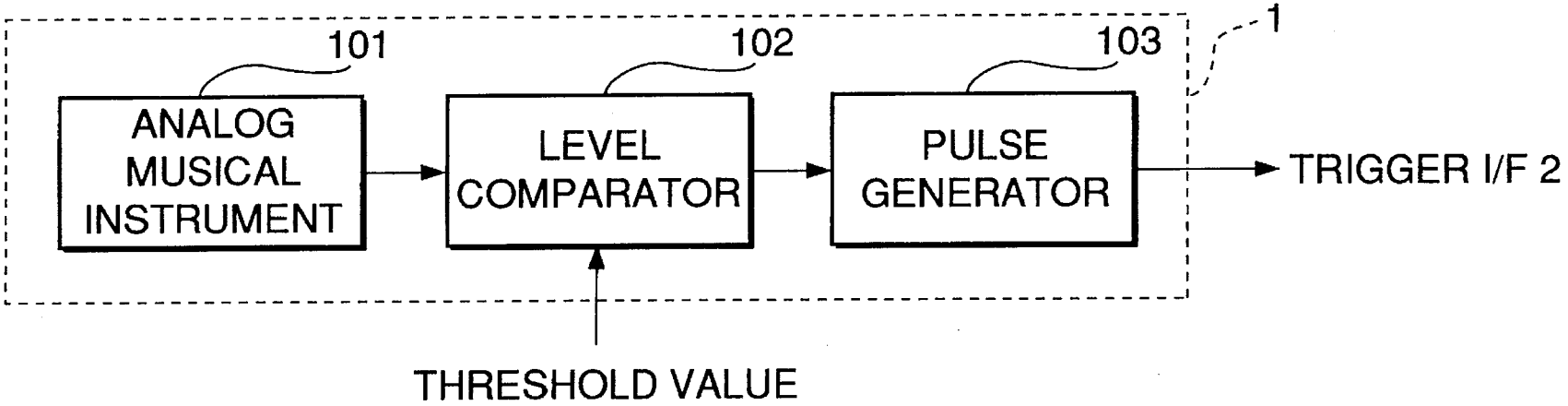
FIG. 2*a* is a block diagram showing an example of the construction of a trigger generator appearing in FIG. 1.

The trigger generator 1 may be formed by a simple switch, but it is preferred that a real musical instrument is used to make the player feel as if he were really playing the musical instrument. Referring to FIG. 2*a*, reference numeral 101 designates an analog musical instrument which outputs an analog signal. An electric guitar, an electric bass guitar, an electronic drum, or the like may be suitably used as the analog musical instrument 1. Further, a trigger may also be suitably detected by a microphone attached to a natural musical instrument (acoustic instrument), provided that the natural musical instrument does not produce too large a natural sound. The analog signal generated from the analog musical instrument 101 is delivered to a level comparator 102, which compares the magnitude of the analog signal with a predetermined threshold level, and causes a pulse generator 103 to generate a trigger when the former exceeds the latter. The trigger is transmitted to the CPU 3 via the trigger interface (I/F) 2.

Figure 2B:
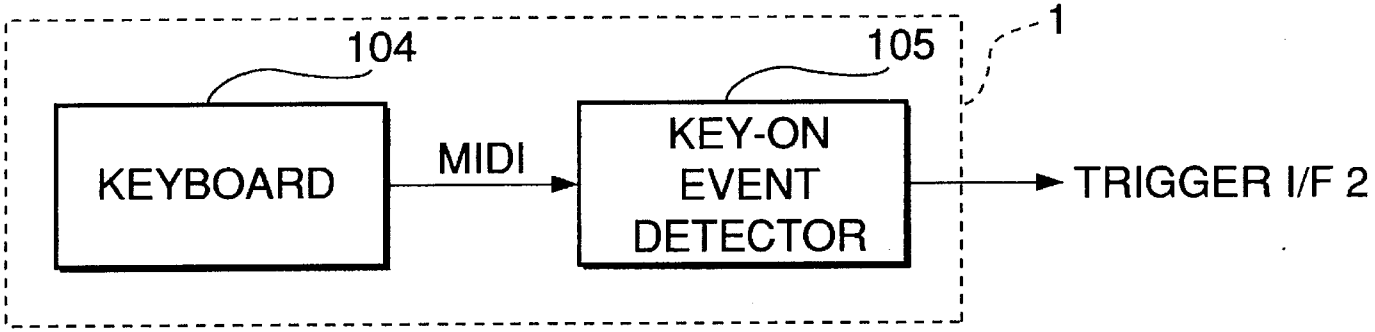
FIG. 2*b* is a block diagram showing another example of the construction of the trigger generator.

Alternatively of the real musical instrument, an electronic musical instrument adapted to generate a MIDI (Musical Instrument Digital Interface) signal may be used as a trigger source or the trigger generator 1. FIG. 2*b* shows another example of the trigger generator 1 utilizing a MIDI keyboard 104. The MIDI keyboard 104 is comprised of a plurality of keys for generating various MIDI signals. However, when it is used as the trigger generator 1 in the present embodiment, a key-on event detector 105 is connected to the MIDI keyboard 104, for detecting a key-on event alone, which occurs with the MIDI keyboard 104, and when a key-on event occurs, the key-on event detector 105 delivers a MIDI signal indicative of the key-on event as a trigger to the CPU 3 via the trigger I/F 2.

Thus, the player can generate a trigger merely by playing on a musical tone having any pitch.

The automatic performance device of the first embodiment operates on programs stored in the ROM 5 appearing in FIG. 1. Details of operations thereof will be described with reference to FIG. 3 to FIG. 11.

Figure 3:
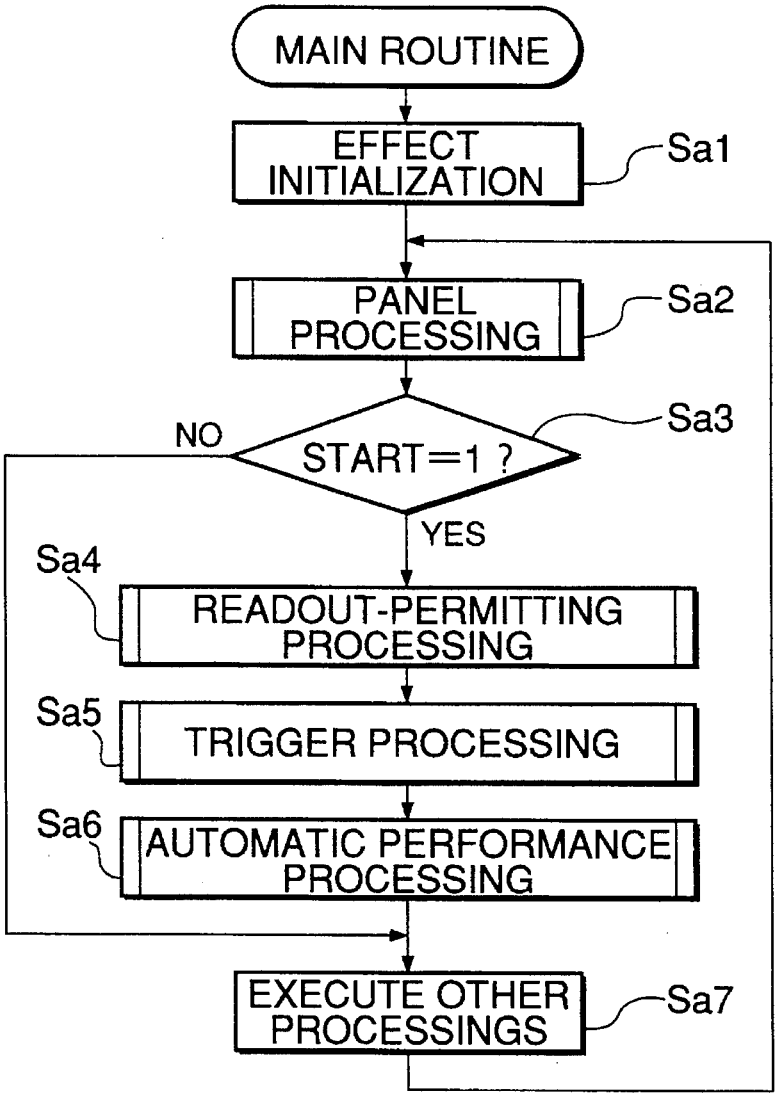
Figure 4:
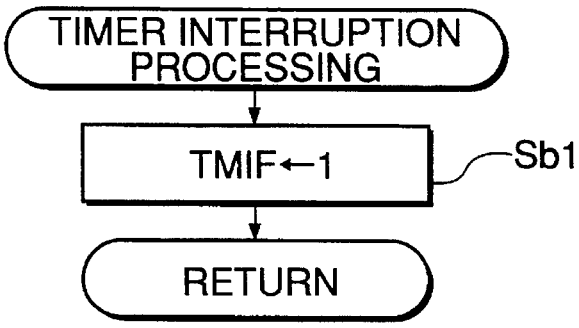

When the player turns on the power supply of the present device, a main routine shown in FIG. 3 is started. First, at a step Sa1, various registers and flags are initialized, and other processings required for initializing the device are executed. Then, a panel processing is carried out by the CPU 3 at a step Sa2, by starting a subroutine shown in FIG. 5.

Figure 5:
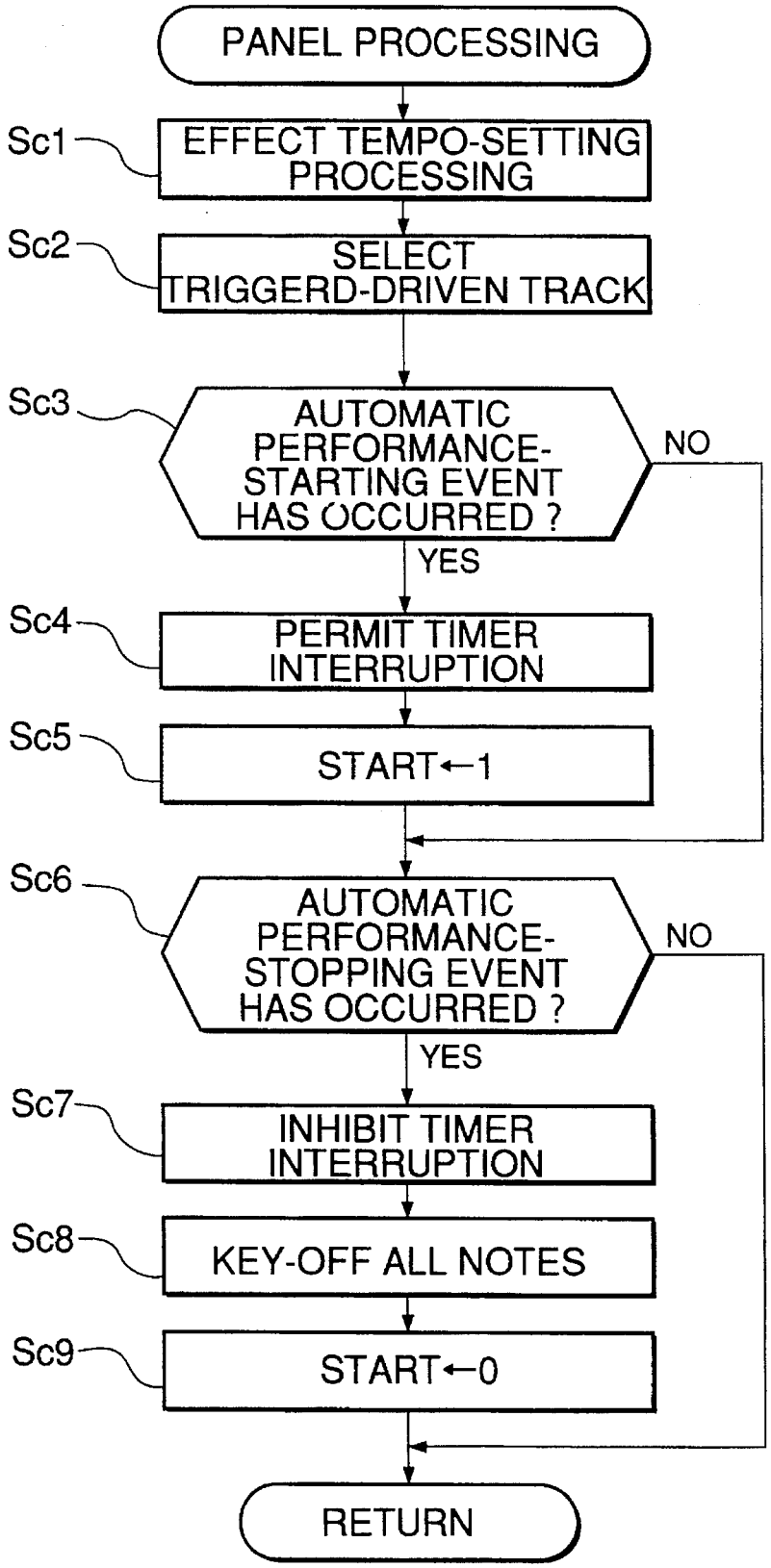

At a step Sc1 of the FIG. 5 subroutine, a temposetting processing is carried out for setting the device such that an interrupt signal is generated at time intervals corresponding to a tempo set by the player via a tempo-setting operating element, not shown, of the operating panel 9. However, since in the present embodiment, a piece of music is played by automatic performance, the tempo of the automatic performance is set in advance according to the piece of the music. Therefore, the intervals of generation of the interrupt signal INT are also set accordingly in advance. However, if the player wishes to change the tempo, he can change it. In the present example, it is assumed that the tempo is left unchanged, and the program proceeds to a step Sc2.

At the step Sc2, when a track is selected as the trigger-driven track from the aforementioned four tracks by the player, data identifying the track selected as the trigger-driven track is stored into the RAM 6. In the present embodiment, the player selects the trigger-driven track from the tracks of piano, bass, drum, and trumpet. In the present example, it is assumed that the track of piano is selected as the trigger-driven track. Accordingly, the remaining tracks of the parts of bass, drum, and trumpet are set as the normal tracks.

Then, the program proceeds to a step Sc3, where it is determined whether or not an automatic performance-starting event has occurred. When the player pushes an automatic performance-starting switch, not shown, of the panel 9, it is regarded that the automatic performance-starting event has occurred, and hence the answer to the question of the step Sc3 becomes affirmative (yes), so that timer interruption is permitted at a step Sc4, and a start flag START is set to 1 to indicate that the automatic performance has been started, at a step Sc5. If the player does not push the automatic performance-starting switch, the answer to the question of the step Sc3 becomes negative (no), and accordingly, the steps Sc4 and Sc5 are not carried out.

Then, the program proceeds to a step Sc6, where it is determined whether or not an automatic performance-stopping event has occurred. When the player pushes an automatic performance-stopping switch, not shown, of the panel 9, it is regarded that the automatic performance-stopping event has occurred, and hence the answer to the question of the step Sc6 becomes affirmative (yes), so that the timer interruption is inhibited at a step Sc7, an all-note off command is given to the tone generator 7 to forcibly key off all musical tones being generated by automatic performance at a step Sc8, and the start flag START indicative of the start of the automatic performance is set to 0 at a step Sc9. If the player does not push the automatic performance-starting switch, the answer to the question of the step Sc6 becomes negative (no), and accordingly, the steps Sc7 to Sc9 are not carried out, followed by returning to the main routine.

In this way, in the panel processing, the temposetting processing is effected when the player has set the tempo of performance, the trigger-driven track-setting processing is effected when the player has selected the trigger-driven track, the timer interruption-permitting/inhibiting operation, and setting of the start flag START are carried out when the player has commanded the start/stop of the automatic performance.

When the player pushes the automatic performance start switch, the timer interruption is permitted at the step Sc4, and accordingly, the interrupt signal INT is generated at time intervals corresponding to the tempo set in advance. When the interrupt signal INT is thus generated, the CPU 3 stops execution of a processing program being carried out at the time point of generation of the interrupt signal INT, and executes a processing program shown in FIG. 4. That is, a timer interruption flag TMIF is set to 1 at a step Sb1, immediately followed by returning to the processing program interrupted. Thus, in the present embodiment, the minimum-size processing program for the timer interruption is executed merely by setting the flag TMIF to 1, and is immediately terminated. This is because if it takes much time to execute the timer interruption, there can be a case in which an interruption processing of higher priority cannot be executed preferentially of the present timer interruption. Substantive steps of the timer interruption processing are carried out at the step Sa6 of the main routine for the automatic performance processing. In the main routine, the steps Sa2 to Sa7 are executed at high speed, so that a time lag between the timer interruption and execution of the automatic performance processing (Sa6) is not large enough to be perceived as a tempo delay in the automatic performance.

Returning to the main routine, it is determined at the step Sa3 whether or not the start flag START is equal to 1. When the player has pushed the automatic performance-starting switch, the answer to this question is affirmative (yes), i.e. START=1, and then, a readout-permitting processing (Sa4), a trigger processing (Sa5), and the automatic performance processing (Sa6) are carried out. If START=0, these steps Sa4 to Sa6 are not carried out. Thereafter, processing programs irrelevant to the present embodiment are executed at the step Sa7, followed by returning to the panel processing (Sa2). Thereafter, the steps Sa2 to Sa7 are repeatedly carried out.

Figure 12:
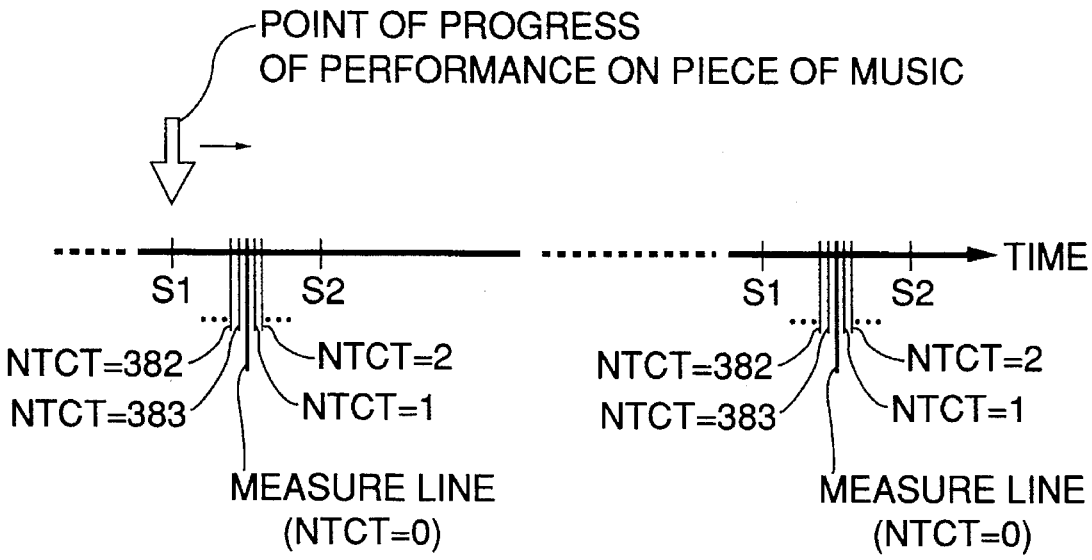
FIG. 12 is a timing chart which is useful in explaining trigger-accepting time periods set in the first embodiment.

In the first embodiment, a trigger-accepting time period for accepting a trigger and a trigger-rejecting time period for rejecting a trigger are alternately set as the automatic performance makes progress. When the player triggers during the trigger-accepting time period while the automatic performance is in process, automatic performance data of one measure is read from the trigger-driven track set as above, to give automatic performance based thereon, whereas even if the player triggers during the trigger-rejecting time period, the triggering action of the player is ignored or made ineffective. This will be explained by referring to FIG. 12. The trigger-accepting time period is set as the performance based on the normal tracks makes progress. When the performance based on the normal tracks enters each portion of the piece of music extending across a measure line from a point S1 to a point S2, the trigger acception is enabled. After the performance based on the normal tracks passes the point S2 and before it reaches a point S1 of the next trigger-accepting time period, the trigger acception is disabled. The present point of progress of performance based on the normal tracks is indicated by a numerical value NTCT set to or counted by a NTCT (Normal Track Counter) register. When NTCT=0, the present point of progress of performance based on the normal tracks exactly corresponds to a measure line. The numeral value NTCT of the NTCT register is increased by an incremental value of 1 whenever the timer interruption occurs (which will be described with reference to a step Sg1 of FIG. 10), When time elapses to reach a time point corresponding to the following measure line, the numerical value NTCT of the NTCT register is reset to 0. In the present embodiment, a quarter note corresponds to 96 clocks, and hence, if one measure is formed by four beats, the measure corresponds to 384 clocks. In the present specification, one clock is defined as a repetition period of the timer interruption, i.e. a time interval between one timer interruption and the next time interruption.

Although the positions of the points S1 and S2 have default values set in advance, they may be changed by the player via the operating panel 9 (see FIG. 1). The position of the point S1 is set by the number of clocks to be generated over a time period from the point S1 to the measure line, and that of the point S2 by the number of clocks to be generated over a time period from the measure line to the point S2.

The position of each point S1 depends on the size of a measure being played by automatic performance, and therefore, if a piece of music which is variable in measure size is played, the position of each point S1 also varies. As shown in FIG. 19, measure sizes are stored in a measure size table in the ROM 5, from which the size of each measure is read out to determine a value indicative of the position of a corresponding point S1. For example, assuming that each point S1 corresponds to a point 48 clocks before each corresponding measure line, if the size of the measure is 383, the value indicative of the position of the point S1 is calculated by an equation of 383−48=335. Similarly, if the size of the measure is 191, the value indicative of the position of the point S1 is calculated by an equation of 191−48=143. On the other hand, the value indicative of the position of each point S2 does not depend on the measure size. Assuming that each point S2 corresponds to a point 96 clocks after each corresponding measure line, the value indicative of the position of the point S2 is 96.

Figure 6:
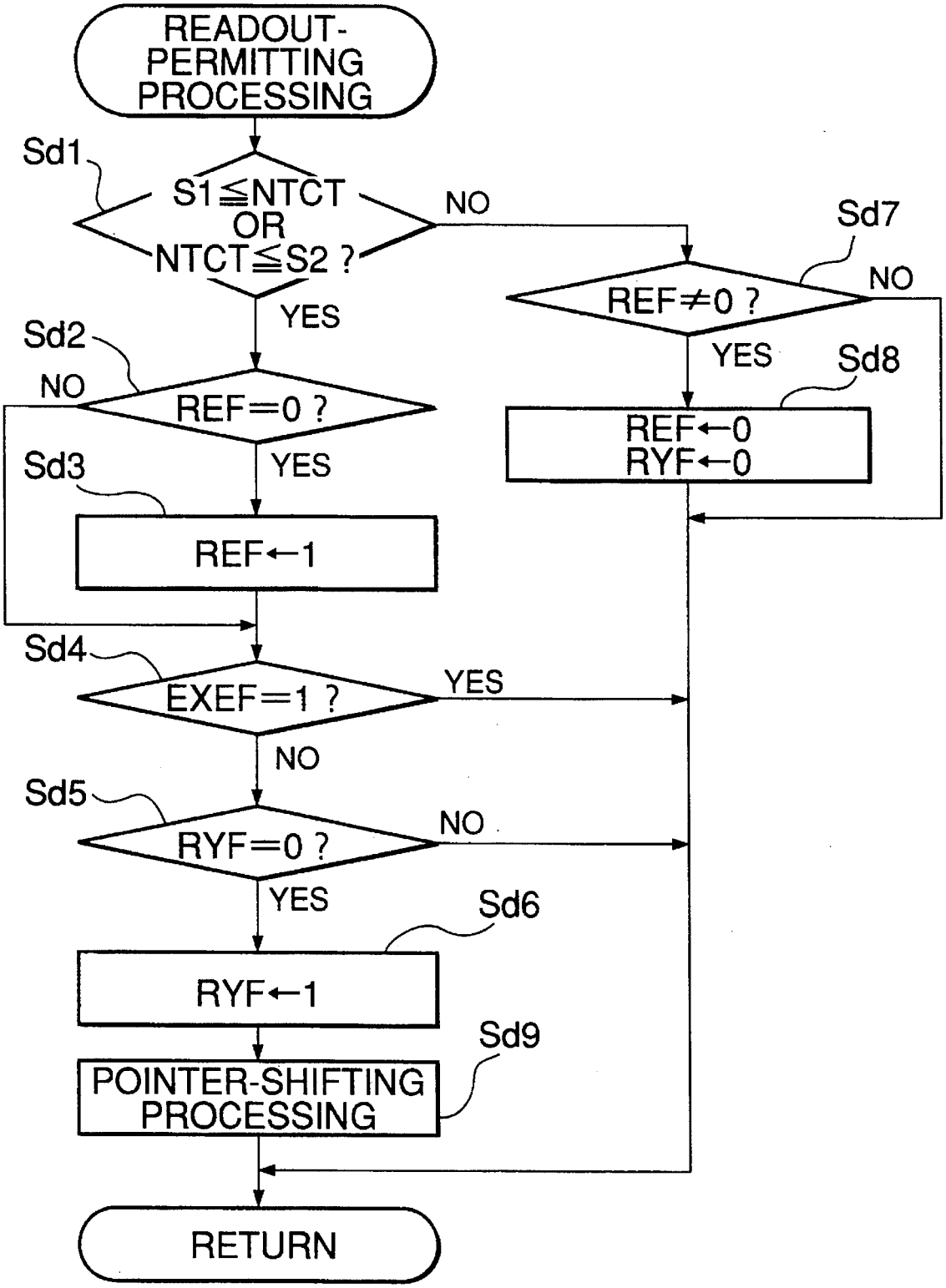

The CPU 3 executes the readout-permitting processing at the step Sa4 of the main routine, according to a readout-permitting subroutine shown in FIG. 6. According to the subroutine, when the automatic performance based on the normal tracks has reached each trigger-accepting time period, a readout-permitting flag REF is set to 1 to indicate that reading of automatic performance data from the trigger-driven track is permitted, and when the automatic performance based on the normal tracks has left the trigger-accepting time period, the flag REF is set to 0. Further, if no trigger has occurred during the trigger-accepting time period, a read address, more specifically a pointer pointing thereto, from which automatic performance data starts to be read out from the trigger-driven track is shifted to a subsequent position.

At a step Sd1 of the FIG. 6 subroutine, it is determined whether or not the numerical value or count value NTCT of the NTCT register corresponds to a time point within a trigger-accepting time period. If the answer to this question is affirmative (yes), i.e. if the automatic performance falls within the trigger-accepting time period, the readout-permitting flag REF is set to 1 if it is equal to 0, but it is not changed if it is already equal to 1 (steps Sd2 and Sd3). On the other hand, if the trigger-accepting time period is over, i.e. if the answer to the question of the step Sd1 is negative (no), it is determined at a step Sd7 whether or not the readout-permitting flag REF is not equal to 0. If the answer to this question is affirmative (yes), the readout-permitting flag REF is set to 0, and at the same time, a ready-for-readout flag RYF for indicating that readout of data on the trigger-driven track is ready when set to 1 is set to 0, at a step Sd8, whereas if the answer is negative (no), the subroutine is immediately terminated to return to the main routine.

From the step Sd2 or Sd3, the program proceeds to a step Sd4, where it is determined whether or not an execution flag EXEF is equal to 1, indicating that the performance based on the trigger-driven track is in process in response to a trigger. If the answer to the question of the step Sd4 is affirmative (yes), the program returns to the main routine, whereas if the answer is negative (no), it is determined at a step Sd5 whether or not the ready-for-readout flag RYE is equal to 0. If the answer to the question of the step Sd5 is negative (no), i.e. if the ready-for-readout flag RYF is equal to 1, the program returns to the main routine since the readout of the data on the trigger-driven track is ready. If the answer to the question of the step Sd5 is affirmative (yes), i.e. if the ready-for-readout flag RYF is equal to 0, a pointer-shifting processing is executed at a step Sd9 since the readout of the automatic performance data is not ready. Since the execution of the pointer-shifting processing sets the readout of the data ready, the ready-for-readout flag RYF is set to 1 in advance at a step Sd6. The step Sd6 may be carried out after the step Sd9.

The pointer-shifting processing (at step Sd9) is for shifting the pointer (pointing to the read address of data from which data should be read out) to the head of the following measure to thereby update data to be read out when a trigger occurs during the following trigger-accepting time period, if no trigger has occurred during the present trigger-accepting time period. The CPU 3 carries out this processing by executing a subroutine shown in FIG. 8.

Since the concept of the head of a measure is difficult to understand, explanation will be made in detail below: If a new measure starts with an item of event data, i.e. if the position of a measure line determining the head of the measure corresponds to an item of event data, the address in which the item of event data is stored represents the starting point of the measure. However, in most automatic performance data prepared by sampling a performance actually given by a player, the measure line does not correspond to event data, i.e. the latter is deviated from the former. In such a case, it is presumed that the measure line corresponds to duration data located between one item of event data and another. Therefore, to determine an accurate position of the head of the measure, a calculation is made to determine the duration from the measure line to the first event data occurring thereafter.

Then, when a trigger occurs, playing of the measure starts with subtraction of the duration calculated from the data.

Figure 8:
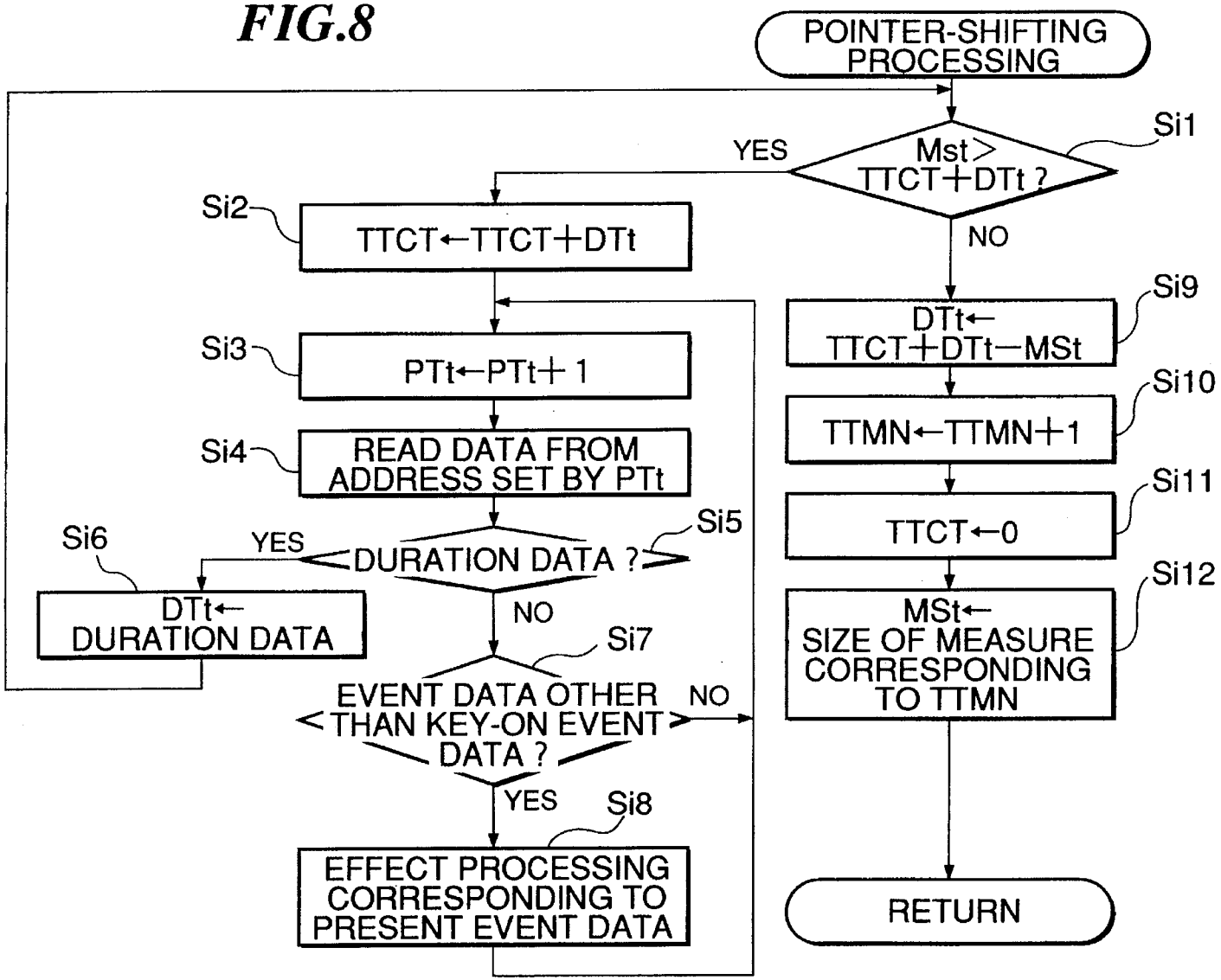

Referring to FIG. 8, it is determined at a step Si1 whether or not the sum of a count value TTCT of a trigger-driven track counter TTCT for measuring a time period over which trigger-driven performance has been given in response to a trigger and a numerical value DTt stored in a duration register DTt, which has its musical value DTt set to each duration data DD on the trigger-driven track and decreased (see a step Sh4 in FIG. 11) as the trigger-driven performance makes progress, is smaller than the size MSt of the present measure of a piece of music the data of which is stored on the trigger-driven track. If the answer to this question is affirmative (YES), there should be some event data before the next measure line is reached. Accordingly, steps Si2 to Si8 are carried out. More specifically, the count value DTt of the duration register DTt is added to the count value TTCT of the trigger-driven track counter TTCT to increase the count value of the latter, at a step Si2, and then a pointer PTt for pointing to the read address of the data on the trigger-driven track is advanced by 1 at a step Si3 to thereby read automatic performance data from the read address of the trigger-driven track pointed to by the pointer PTt at a step Si4. If the automatic performance data read out is event data (i.e. if the answer to the question of a step Si5 is negative (no)), event data other than key-on data is properly processed, at steps Si7 and Si8, followed by returning to the step Si3. If the event data is key-on data, the key-on processing is not permitted, followed by returning to the step Si3. The inhibition of the key-on processing prevents a musical tone from being generated, while permitting processing of event data other than the key-on processing, such as the key-off processing and the program change, to prevent a musical tone from being continuously generated, and enable changes to be made to the tone quality of musical tones, etc., whereby the performance of the next measure started by a trigger can be prevented from being changed into an improper one.

If the data read out at the step Si4 is duration data (i.e. if the answer to the question of the step Si5 is affirmative (yes), the data is stored into the register DTt at a step Si6, followed by returning to the step Si1. The steps Si2 to Si8 are repeatedly carried out until the answer to the question of the step Si1 becomes negative (no). This makes it possible to promptly process all the event data that remains unprocessed, of the present measure except the key-on data. Further, in some cases, it is preferable that the key-on data should be also processed. In such cases, therefore, the routine may be modified such that the key-on data is also processed.

If the sum of the count value of the trigger-driven track counter TTCT and the numerical value indicated by the duration register DTt is larger than the size MSt of the measure, it means that the duration data stored in the duration register DTt extends over the measure line. Therefore, the size MSt is subtracted from the sum to obtain duration from the measure line up to the next item of the event data occurring thereafter. Data indicative of the thus calculated duration is stored into the duration register DTt. At this time point, preparation for reading the automatic performance data starting with the head of the next measure is completed, and hence a value TTMN set into a TTMN register for indicating the measure number of a measure on the trigger-driven track is increased by an incremental value of 1 at a step Si10, and the count value of the trigger-driven track counter TTCT is reset to 0 at a step Si11. The size of the next measure is read from the measure size table shown in FIG. 19 by referring to the value TTMN set into the TTMN register, and stored into a measure size (MSt) register at a step Si12. Then, the program returns to the readout-permitting processing (in FIG. 6), and then returns to the main routine.

Figure 7:
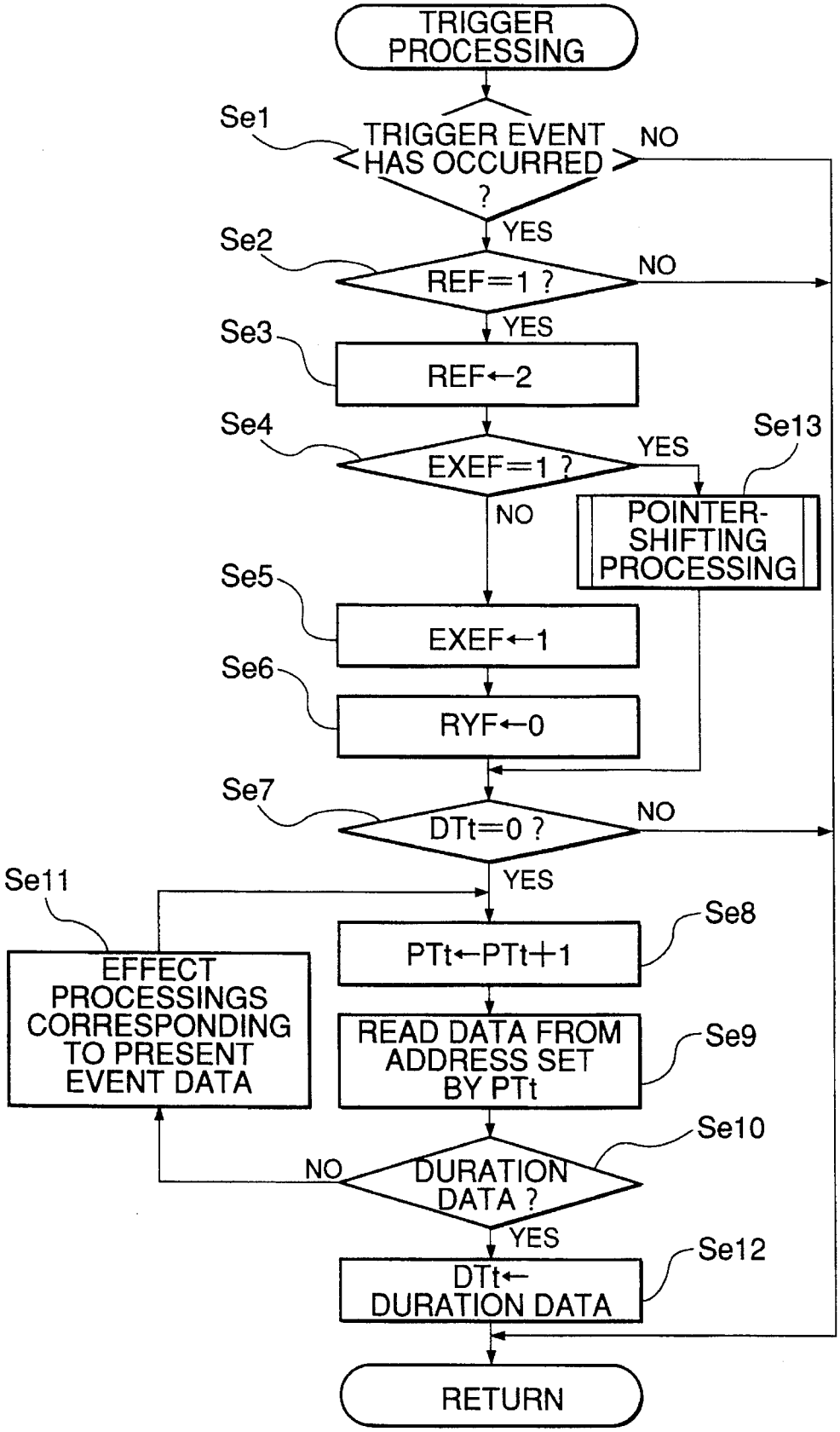

The CPU 3 executes the trigger processing at the step Sa5 of the main routine, according to a trigger-processing subroutine shown in FIG. 7.

When the player generates a trigger by the trigger generator 1 with the readout-permitting flag REF being equal to 1, both the answers to the questions of steps Se1 and Se2 of this subroutine become affirmative (yes), and accordingly the readout-permitting flag is set to 2 at a step Se3. The reason for setting the readout-permitting flag REF to 2 is that when the step Se2 is carried out the next time, the answer to the question thereof becomes negative (no), whereby it is possible to prevent the following steps Se3 to Se13 from being doubly carried out. If no trigger event occurs (when no trigger is generated), i.e. if the answer to the question of the step Se1 is negative (no), or if the readout-permitting flag REF is not equal to 1, i.e. if the answer to the question of the step Se2 is negative (no), the program immediately returns to the main routine.

If the answer to the question of the step Se4, is negative (no), the flag EXEF is set to 1 at a step Se5, and then the ready-for-readout flag RYF is set to 0 at a step Se6. The reason for setting the readout-permitting flag RYF to 0 is that starting of the readout of the trigger-driven track cancels the ready-for-readout state of the device.

If the answer to the question of the step Se4 is affirmative (yes), the pointer-shifting processing is executed at a step Se13. This step is executed when the readout-permitting time period has started and the player has generated a trigger before the automatic performance having been given in response to the preceding trigger is terminated. More specifically, the step is executed when the timing of a triggering action by the player for the present measure was before the starting measure line thereof, i.e. the player triggered too early, or the timing of a triggering action by the player for the immediately preceding measure was too late, resulting in overlapped portions of music selected by the triggering actions for trigger-driven automatic performance. In such a case, since the trigger-driven automatic performance should start playing the following measure at the timing of triggering, the measure being currently played for the trigger-driven automatic performance is interrupted, and the pointer PTt of the trigger-driven track is shifted to the head of the following measure. This processing is executed by the FIG. 8 subroutine, description of details thereof having being given above, and hence being omitted here.

Then, the program proceeds to a step Se7. Since the pointer PTt has been shifted by the pointer-shifting processing at the step Se13, if the head of a new measure occurs with event data, the calculated duration DTt is equal to 0, so that steps Se8 to Se12 are carried out. If the duration data extends across the measure line, it results in DTt>0, and hence the program returns to the main routine.

The processing through the steps Se7 to Se12 is performed in the following manner: If the numerical value indicated by the duration register DTt for the trigger-driven track is equal to 0 (if the answer to the question of the step Se7 is affirmative (yes)), the pointer PTt is advanced by 1 at a step Se8. Then, automatic performance data on the trigger-driven track is read out from the address pointed to by the pointer PTt at a step Se9. If the data read out is event data (i.e. if the answer to the question of a step Se10 is negative (no)), the processing corresponding to the type of event thereof is carried out at a step Se11, followed by returning to the step Se8. The above procedure is continued until the data read out at the step Se9 is determined to be duration data, whereupon (i.e. if the answer to the question of the step Se10 is affirmative (yes)), the duration data is stored into the duration register DTt at a step Se12, followed by returning to the main routine.

As described above, the trigger-processing subroutine (shown in FIG. 7) is executed for automatic performance based on the trigger-driven track when a trigger is generated, and it is put into execution in response to only one trigger having occurred during one trigger-accepting period.

Figure 9:
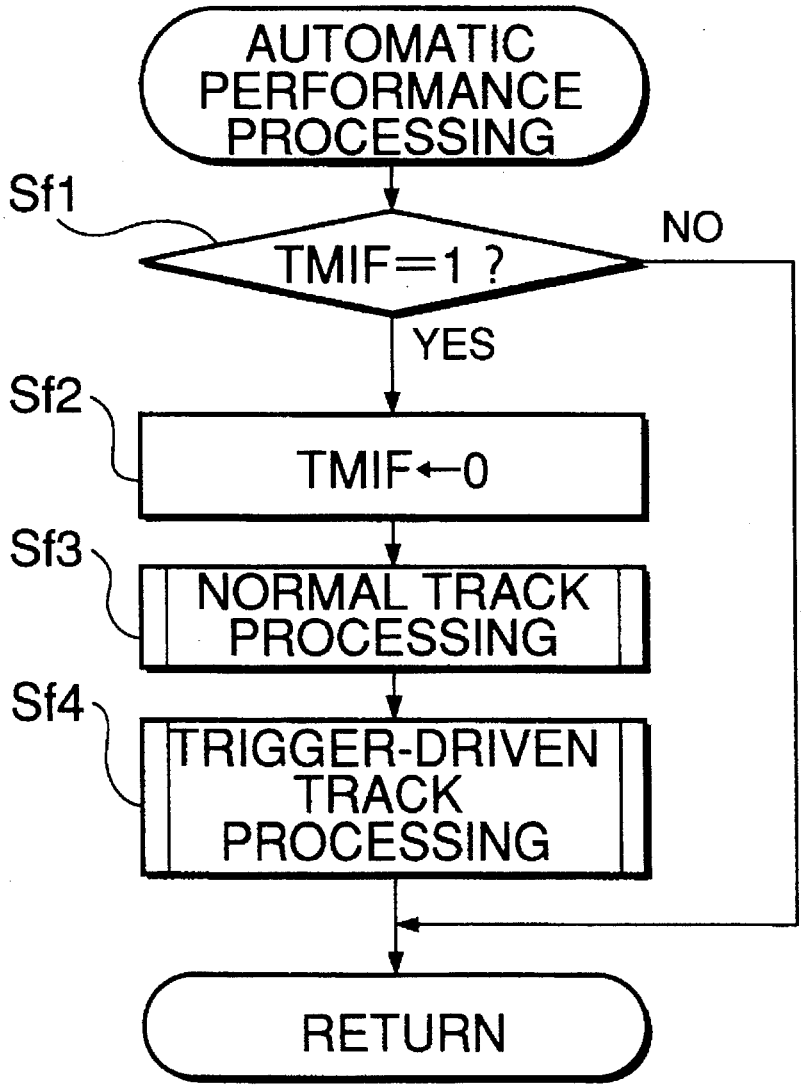

The CPU 3 executes the automatic performance processing at the step Sa6 of the main routine, according to an automatic performance subroutine shown in FIG. 9. At a step Sf1, it is determined whether or not the timer interruption flag TMIF is equal to 1. If the answer to this question is affirmative (yes), i.e. if there has occurred a timer interruption, the processing through steps Sf2 to Sf4 is carried out, whereas if the answer is negative (no), the program immediately returns to the main routine since it is not timing for execution of these steps. At the step Sf2, the timer interruption flag TMIF is set to 0, thereby preventing the processing of the steps Sf3 and Sf4 from being carried out until a subsequent timer interruption occurs.

Figure 10:
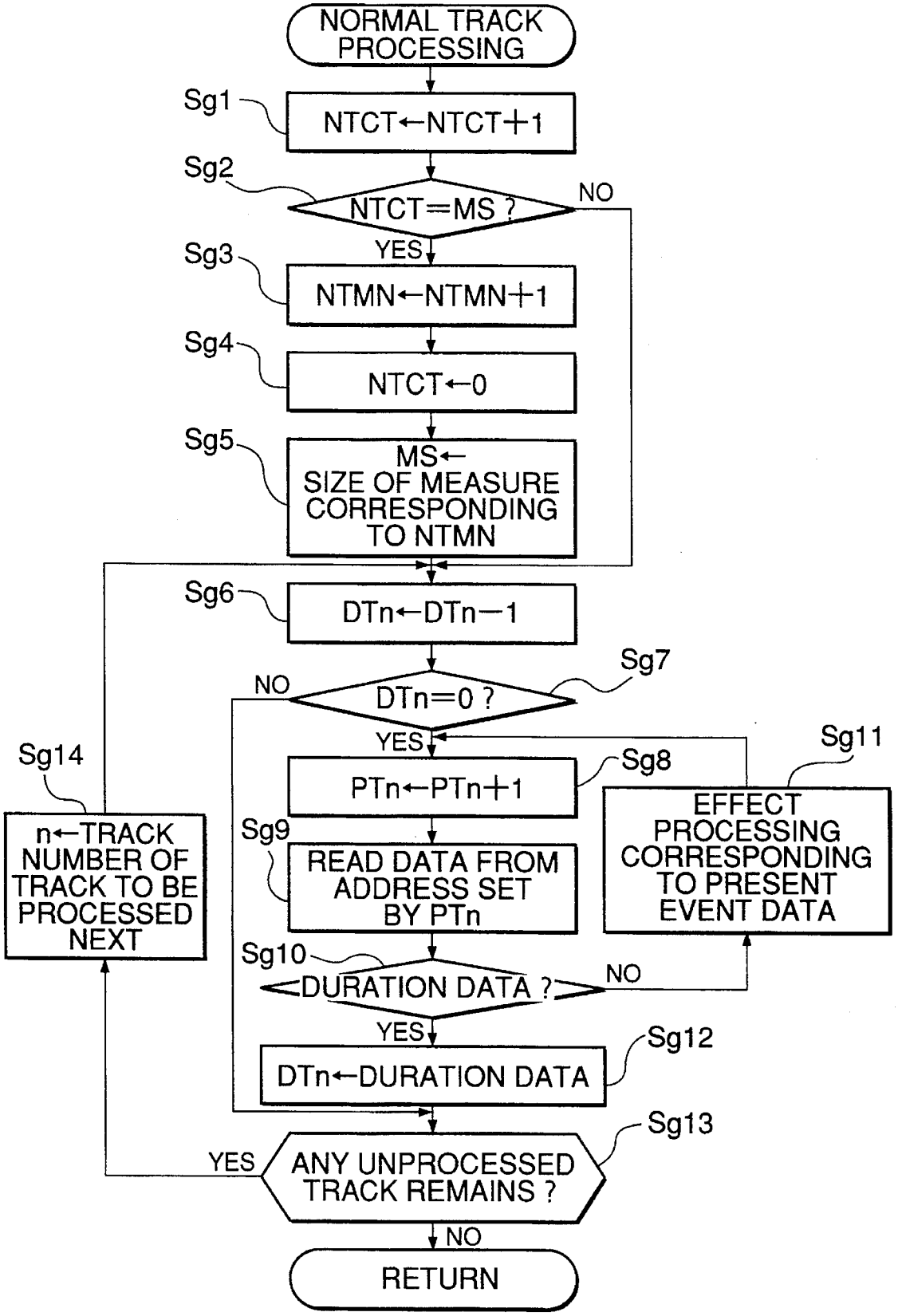

The normal track processing of the step Sf3 is carried out according to a subroutine shown in FIG. 10 to give automatic performance based on the normal tracks. At a step Sg1, the count value NTCT of the normal track counter NTCT is increased by an incremental value of 1, and then it is determined at a step Sg2 whether or not the performance has reached the end of the present measure. This determination is carried out by comparing the count value of the normal track counter NTCT with the size MS of the present measure being played. If the count value NTCT of the counter NTCT is equal to the size MS of the measure (i.e. if the answer to the question of the step Sg2 is affirmative (yes)), it means that the point of progress of the performance based on the normal tracks has reached the end of the present measure, the measure number NTMN of the normal tracks is increased by an incremental value of 1 at a step Sg3, and the count value of the counter NTCT is reset to 0 at a step Sg4. Then, based on the updated value of the measure number NTMN of the normal tracks, the size of the following measure is read out from the measure size table shown in FIG. 19, and stored into the measure size register MS at a step Sg5. If the answer to the question of the step Sg2 is negative (no), i.e. if it is determined that the performance has not reached the end of the present measure, the program skips over the steps Sg3 to Sg5 to the step Sg6.

The processing through the steps Sg6 to Sg12 is executed separately for each of the normal tracks. The affix n attached to the symbol DT for the numerical value indicated by the duration data register and the symbol PT for the pointer appearing in FIG. 10 designates a track number being processed. In the present embodiment, it is assumed that there are four tracks provided, respectively, for the parts of piano, bass, drum, and trumpet, which have respective serial numbers assigned thereto. In the present example, the track for piano is selected as the trigger-driven track, and accordingly the above processing is carried out on the normal tracks for the parts of bass, drum, and trumpet.

More specifically, the automatic performance processing is carried out on one of the normal tracks through the steps Sg6 to Sg12, and if there remains any unprocessed track, i.e. if the answer to the question of a step Sg13 is affirmative (yes), the track number indicated by the affix n is set to the number of a subsequent track for processing at a step Sg14, followed by returning to the step Sg6. In this manner, each of the tracks is subjected to the automatic performance processing one after another. In the present example, the numbers n of the normal tracks for bass, drum, and trumpet are set to 2, 3, and 4, respectively.

The processing of the steps Sg6 to Sg12 per se is quite identical to that of the steps Se7 to Se12 of the FIG. 7 subroutine described hereinbefore, and hence description thereof is omitted. When the trumpet part is finished, there is no normal track left unprocessed (i.e. the answer to the question of the step Sg13 is negative (no)), the program returns to the automatic performance processing shown in FIG. 9.

Figure 11:
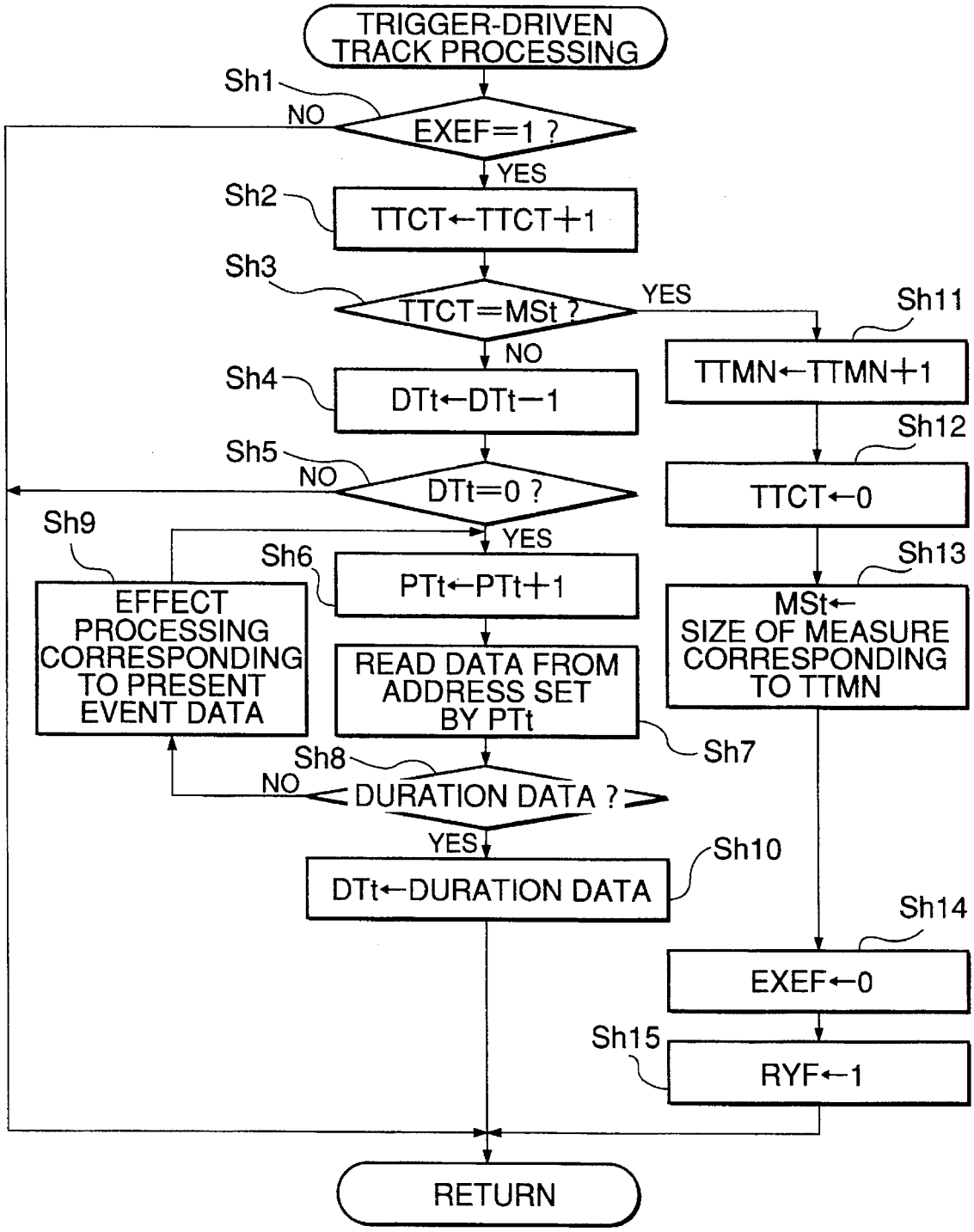

The trigger-driven track processing at the step Sf4 of the FIG. 9 subroutine is carried out according to a subroutine shown in FIG. 11. According to this program, the automatic performance processing is carried out on the trigger-driven track in response to a trigger.

When the player generates a trigger during the readout-permitting period (i.e. REF=1) by the trigger generator 1, the execution flag EXEF is set to 1 at the step Se5 of the FIG. 7 subroutine, and accordingly, the answer to the question of a step Sh1 of the FIG. 11 subroutine as to whether or not the execution flag EXEF is equal to 1 becomes affirmative (yes). Then, the program proceeds to a step Sh2, where the count value of the trigger-driven track counter TTCT is increased by an incremental value of 1. At a step Sh3, it is determined whether or not the count value of the trigger-driven track counter TTCT is equal to the measure size MSt of the measure being processed for the trigger-driven automatic performance. If the point of progress of the trigger-driven automatic performance does not correspond to the end of the measure (i.e. if the answer to the question of the step Sh3 is negative (no)), the numerical value DTt indicated by the duration register DTt is decreased by a decremented value of 1 at the step Sh4 referred to hereinbefore, and then the trigger-driven automatic performance processing is carried out through steps Sh4 to Sh10. Details of this processing through the steps Sh4 to Sh10 per se is quite identical to that of the steps Se7 to Se12 of the FIG. 7 routine described hereinbefore, and hence description thereof is omitted. When the processing by the steps Sh4 to Sh10 is completed, the program immediately returns to the automatic performance processing of the FIG. 9 subroutine, and then returns to the FIG. 3 main routine.

When the execution flag EXEF is not equal to 1 (the answer to the question of the step Sh1 is negative (no)), the program returns to the automatic performance processing subroutine of FIG. 9, and then returns to the main routine of FIG. 3.

When it is determined that the point of progress of the automatic performance based on the trigger-driven track has reached the end of a measure (i.e. if the answer to the question of the step Sh3 is affirmative (yes), the measure number TTM of the trigger-driven track is increased by an incremental value of 1 at a step Sh11, and the trigger-driven track counter TTCT is reset to 0 at a step Sh12. Then, the size of the measure is read from the measure size table shown in FIG. 19, based on the updated value of the measure number TIMN, and stored into the measure size register MSt at a step Sh13. When the point of progress of performance based on the trigger-driven track has reached the end of the measure, the execution flag EXEF is set to 0, to interrupt the automatic performance based on the trigger-driven track at a step Sh14. The fact that the point of progress of performance of the trigger-driven track has reached the end of the measure means that the readout of data of the following measure is ready, and hence the ready-for-readout flag RYF is set to 1 at a step Sh15. Then, the program returns to the automatic performance processing of FIG. 9, and then to the main routine of FIG. 3.

The automatic performance processing based on the trigger-driven track (from the step Sh4 to the step Sh10) per se is essentially identical to that based on the normal tracks. Since there is used only one kind of interrupt signal INT, the tempo of music set for the former is necessarily identical to that set for the latter. However, the timing of starting the automatic performance based on the trigger-driven track differs from measure to measure, and hence compared with the ordinary automatic performance (i.e. the case in which the track currently selected as the trigger-driven track is processed in the same manner as the normal track), the timing of starting the performance can become earlier or later than the proper timing from measure to measure. This makes the player really feel that he is controlling the trigger-driven track, and hence he actually takes part in the performance.

Next, a second embodiment of the invention will be described with reference to FIG. 13 to FIG. 19. For the sake of simplicification, description of those which are identical to the first embodiment are omitted, and only peculiar features of the second embodiment will be described hereinbelow.

In the second embodiment, performance based on a single tone musical instrument part is given by generation of a trigger. The second embodiment is distinguished from the first embodiment in that in the first embodiment a trigger is accepted for each of predetermined sections (measures) dividing a piece of music to be played, whereas in the second embodiment, a musical tone corresponding to one note is reproduced whenever a trigger is accepted.

More specifically, in the second embodiment, key-on data is retrieved from data on the trigger-driven track, and stored into an event buffer. When a trigger is generated, the key-on data is read from the event buffer to generate a musical tone. A retrieval pointer for searching the trigger-driven track for data of notes precedes a read pointer for the normal tracks by a predetermined time period (in the present embodiment, corresponding to the number of clocks for precedence), whereby it is possible to reproduce a musical tone even if the timing of triggering is earlier than the proper timing of a note for performance. The event buffer is rewritten when the retrieval pointer has searched out key-on data, irrespective of occurrence of a trigger. The time period for accepting the trigger is equal to a time period for performance indicated by each note, but it is timingwize shifted in the forward direction with respect to each note by the predetermined time period by which the retrieval pointer precedes.

The second embodiment is particularly adapted to give automatic performance of a single tone musical instrument part by triggering.

In the first embodiment previously described, the automatic performance of a measure is given in response to a trigger generated in the vicinity of a measure line thereof indicative of the start of the measure, but in the second embodiment, a musical tone (single tone) is generated at timing set by triggering in the vicinity of the timing of reproducing a musical tone.

The hardware construction of the automatic performance device according to the second embodiment is identical to that of the first embodiment shown in FIG. 1, and hence description thereof is omitted.

Next, the operation of the automatic performance device according to the second embodiment will be described with reference to FIG. 13 to FIG. 17.

Figure 13:
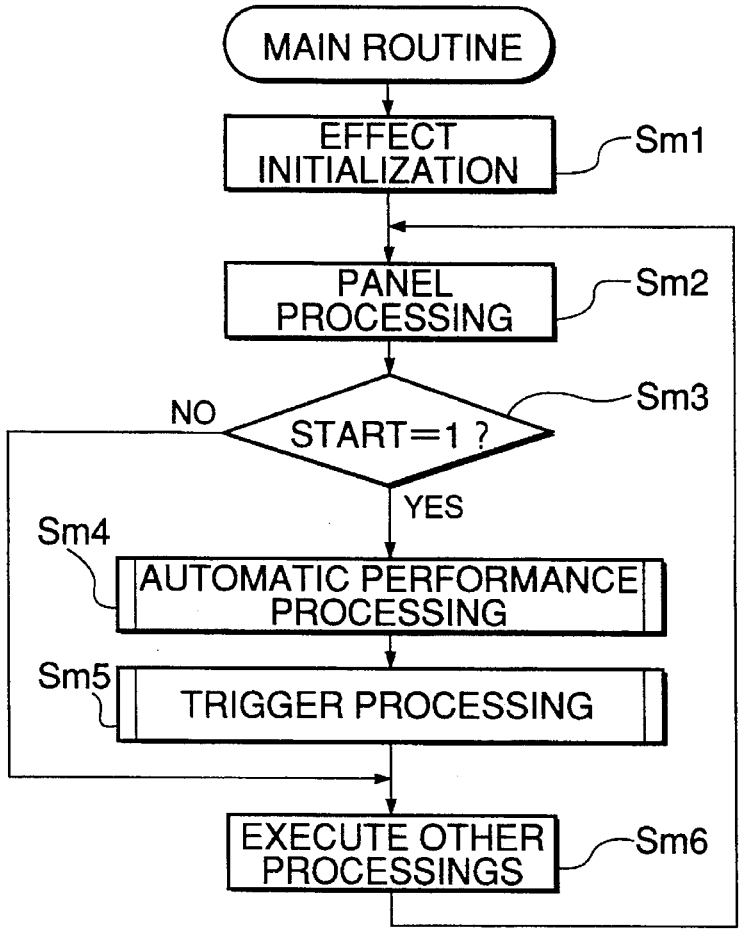
FIG. 13 is a flowchart of a main routine according to the second and third embodiments.
Figure 14:
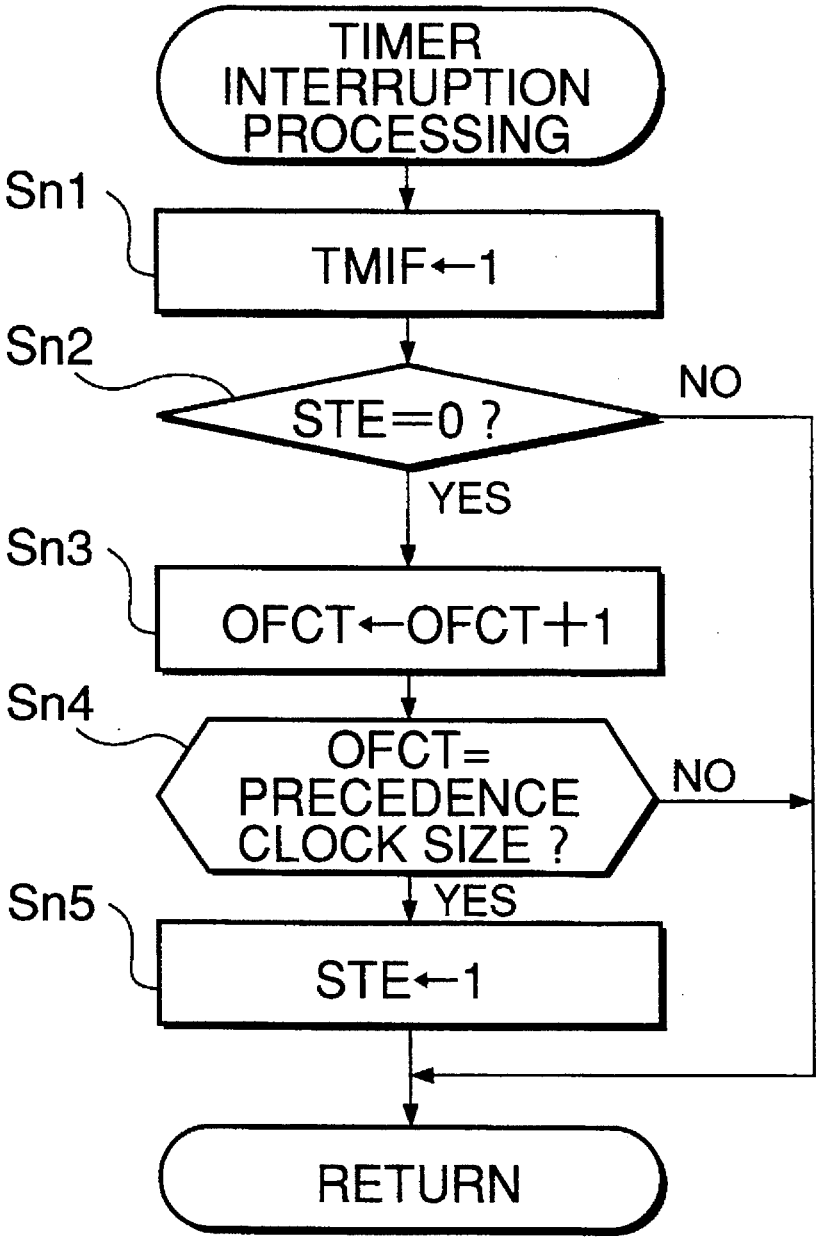

FIG. 13 shows a main routine. When the player turns on the power supply, an initial setting processing for setting initial values to various registers and flags is carried out at a step Sm1. Particularly, a flag STE and a register OFCT are each set to 0, and registers DTk and DTt are set to 1. Next, a panel processing is carried out at a step Sm2. The panel processing is executed by calling the subroutine shown in FIG. 5 into execution. Since this panel processing subroutine is identical to that used in the first embodiment, description thereof is omitted. The second embodiment is suitable for driving a single tone musical instrument by triggering, and therefore, at the step Sc2 in FIG. 5, the trigger-driven track, which is set to the track for piano part in the first embodiment, should preferably be set to the track for bass part or the track for trumpet part in the present embodiment.

At a step Sm3, it is determined whether or not a start flag START is equal to 1. If the answer to this question is affirmative (yes), the CPU 3 executes an automatic performance processing at a step Sm4 and a trigger processing at a step Sm5, whereas if the answer is negative (no), the steps Sm4 and Sm5 are not executed.

Then, other processing programs are executed at a step Sm6, followed by returning to the step Sm2. Thereafter, the steps Sm2 to Sm6 are repeatedly carried out.

When the player pushes the automatic performance starting switch, timer interruption is permitted (at the step Sc4 in FIG. 5), and accordingly an interrupt signal INT is generated at time intervals corresponding to the tempo set for the performance. Upon generation of the interrupt signal INT, the CPU 3 stops a processing being currently executed, and then executes a timer interruption subroutine shown in FIG. 14. More specifically, a timer interruption flag TMIF is set to 1 at a step Sn1, and it is determined at a step Sn2 whether or not a start enabling flag STE is equal to 0. If the start enabling flag STE is equal to 0, the automatic performance is not executed, but only after it is confirmed that the start enabling flag STE is equal to 1, the automatic performance is given. A time period over which the start enabling flag STE continues to be equal to 0 is equal to a time period to be elapsed from the time the automatic performance starting switch is pushed to the time the count value of a counter counting the number of times of the timer interruption becomes equal to a predetermined value corresponding to a predetermined size of precedence clocks. Since the interval of timer interruption varies with the tempo set, the time period also varies accordingly, over which the start enable flag STE continues to be equal to 0. The start enable flag STE should be equal to 0 when the automatic performance is in stoppage, and hence the start enable flag STE is set to 0 when the initial setting processing is executed at the step Sm1 or when an automatic performance stopping switch is pushed. Accordingly, immediately after the automatic performance starting switch is pushed, the start enable flag STE remains equal to 0.

If the start enable flag is equal to 0, i.e. if the answer to the question of the step Sn2 is affirmative (yes), the value to be set to the register OFCT is increased by an incremental value of 1 at a step Sn3, and when the resulting register value is equal to the precedence clock size (i.e. if the answer to the question of a step Sn4 is affirmative (yes)), the start enable flag STE is set to 1 at a step Sn5. If the answer to the question of the step Sn2 is negative (no), i.e. if the start enable flag STE is equal to 1, or if the answer to the question of the step Sn4 is negative (no), i.e. if the value set to the register OFCT has not reached the precedence clock size, or if the processing by the step Sn5 is effected, the program returns to the processing being executed immediately before the timer interruption occurred. The register OFTC is set to 0 when the initial setting is effected at the step Sm1, and also when the automatic performance stop switch is pushed.

The precedence clock size is preferably set to a value equal to or smaller than half the size of the minimum note of the automatic performance data stored on the trigger-driven track. If the precedence clock size is too large, there can be a case in which even if a trigger is generated at the optimum timing, the proper automatic performance cannot be given since then the event buffer has already been rewritten. Further, the precedence clock size may be changed as the player becomes more skilled, thereby setting severer conditions for performance.

Figure 15:
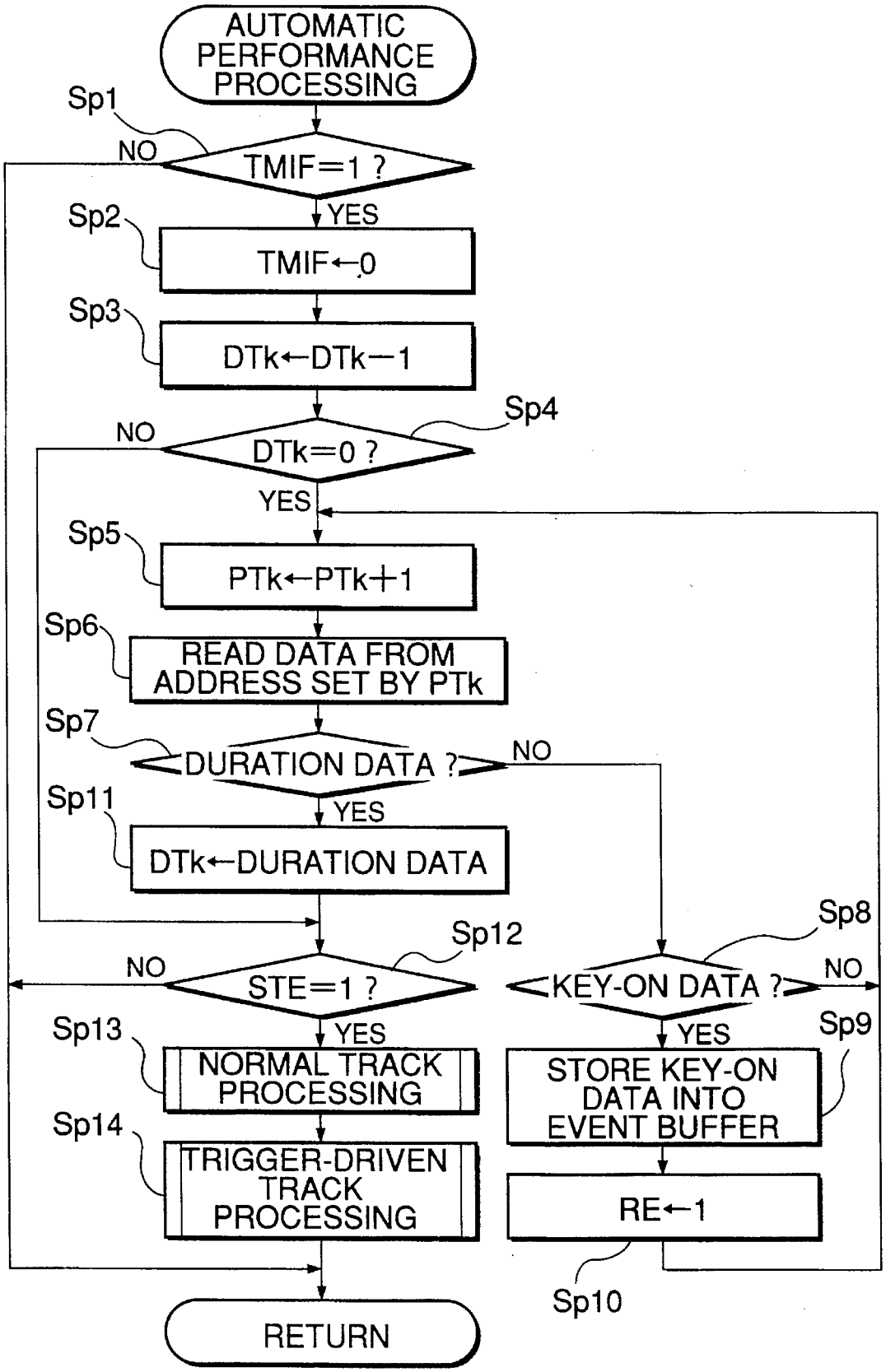

The automatic performance processing at the step Sm4 of the FIG. 13 main routine is executed according to an automatic performance subroutine shown in FIG. 15. This subroutine carries out processing for searching the trigger-driven track for key-on data and storing same into the event buffer, the normal track processing, and trigger-driven track processing except the key-on processing.

At a step Sp1 of the FIG. 15 subroutine, it is determined whether or not the timer interruption flag TMIF is equal to 1 indicating occurrence of timer interruption. If the answer to this question is negative (no), i.e. if there has been no timer interruption, the program immediately returns to the main routine, whereas if the answer is affirmative (yes), i.e. if there has occurred timer interruption, the following steps Sp2 to Sp14 are carried out. More specifically, the timer interruption flag TMIF is set to 0 at the step Sp2, the value to be set to the duration register DTk for retrieval of key-on data is decreased by 1 at the step Sp3, and it is determined at the step Sp4 whether or not the resulting register value is equal to 0. If the answer to this question is affirmative (yes), the key-on data retrieval pointer PTk is advanced by 1 at a step Sp5, and automatic performance data on the trigger-driven track is read from the read address set by the pointer PTk at the step Sp6. Then, it is determined at the step Sp7 whether or not the read data is duration data. If the answer to this question is affirmative (yes), the duration data is stored into the duration register DTk for retrieval of key-on data at at the step Sp11, followed by the program proceeding to the step Sp12.

If the answer to the question of the step Sp7 is negative (no), it is determined at the step Sp8 whether or not the read data is key-on data. If the answer to this question is affirmative (yes), the key-on data is stored into the event buffer set in the RAM 6 at the step Sp9, and then a readout-permitting flag RE for permitting reading of data from the event buffer is set to 1 at the step Sp10, followed by the program returning to the step Sp5. If the answer to the question of the step Sp8 is negative (no), i.e. if the read data is not the key-on data, the program also returns to the step Sp5. If the answer to the question of the step Sp4 is negative (no), i.e. if the resulting value set to the duration register DTk is not equal to 0, the program jumps over to the step Sp12. At the step Sp12, it is determined whether or not the start enable flag STE is equal to 1. If the answer to this question is affirmative (yes), the normal track processing is carried out at the step Sp13, and the trigger-driven track processing is carried out at the step Sp14, followed by returning to the main routine. If the answer to the question of the step Sp12 is negative (no), i.e. if the start enable flag STE is not equal to 1, the program returns to the main routine without executing the steps Sp13 and Sp14. Therefore, so long as STE=0, the ordinary automatic performance based on the normal tracks is not executed, but the steps Sp5 to Sp11 are executed for retrieval of key-on data on the trigger-driven track.

The normal track processing (at the step Sp13) is similar to that of the first embodiment shown in FIG. 10, and hence description thereof is omitted. The trigger-driven track processing at the step Sp14 is executed according to a subroutine shown in FIG. 16. This processing is identical to the normal track processing except that key-on data is not processed. That is, data except the key-on data, such as key-off data, program change data, and control change data are processed at the same timing as in the ordinary automatic performance (where the present trigger-driven track is subjected to the ordinary or conventional automatic performance as the normal track).

Figure 16:
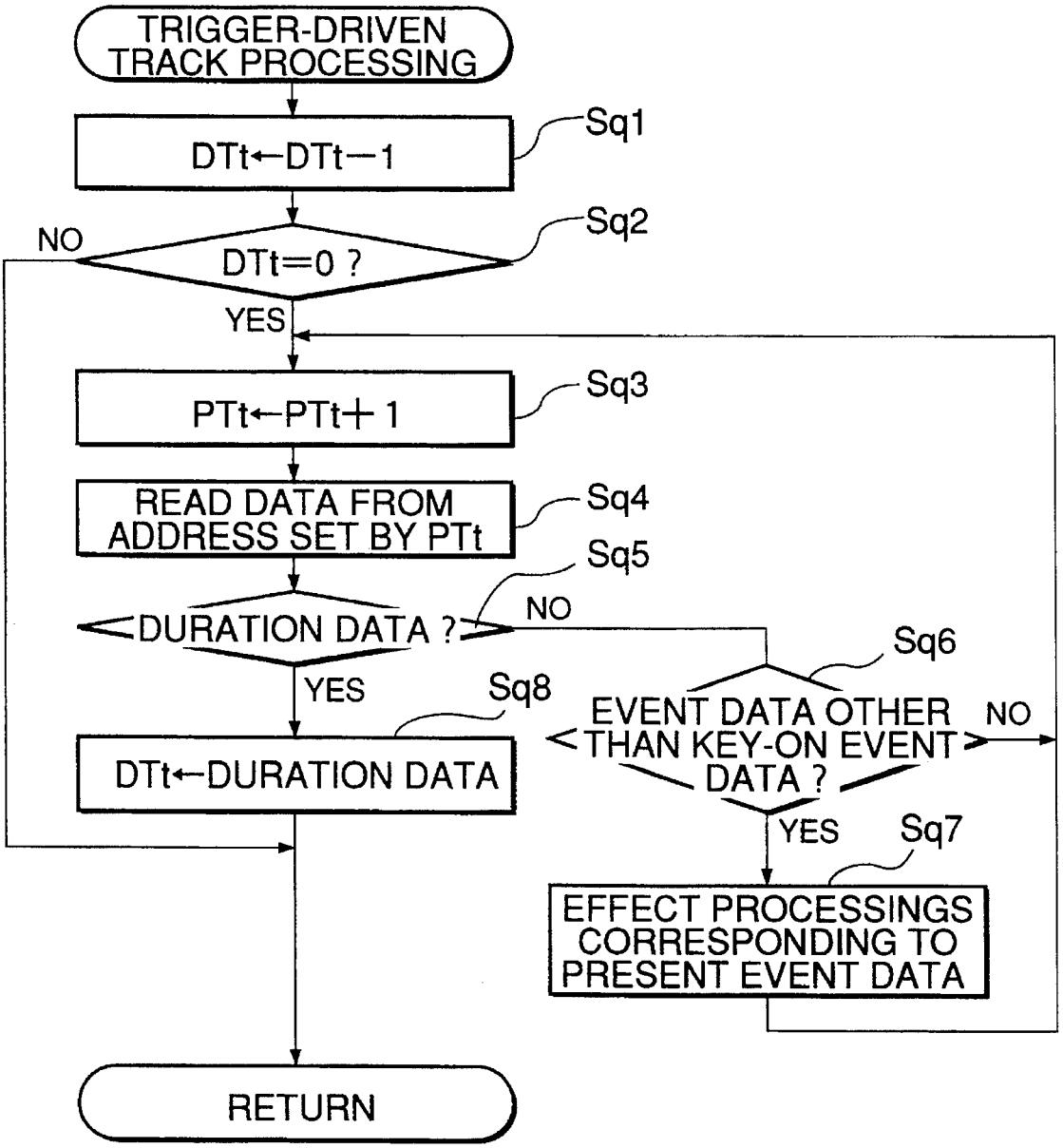

At a step Sq1 of the FIG. 16 subroutine, the value DTt to be set to the duration register DTt for the trigger-driven track is decreased by a decremental value of 1, and it is determined at a step Sq2 whether or not the resulting register value is equal to 0. If the answer to the question is affirmative (yes), i.e. if the resulting register value is equal to 0, steps Sq3 to Sq8 are carried out, whereas if the answer is negative (no), i.e. if the resulting value is not equal to 0, the program returns without executing these steps.

At the step Sq3, the pointer PTt for reading automatic performance data on the trigger-driven track is advanced by 1, and automatic performance data on the trigger-driven track is read from the read address pointed to by the pointer PTt at a step Sq4. If the read data is duration data (i.e. if the answer to a question of the step Sq5 is affirmative (yes)), the duration data is stored into the duration register DTt at the step Sq8, followed by returning to the FIG. 15 program. Further, if the answer to the question of the step Sq5 is negative (no), the program proceeds to the step Sq6, where it is determined whether or not the read data is event data other than key-on data. If the answer to this question is affirmative (yes), the event data is processed at the step Sq7, followed by returning to the step Sq3. If the answer to the question of the step Sq6 is negative (no), it means that the read data is key-on data, the program returns to the step Sq3, without processing the data.

Figure 17:
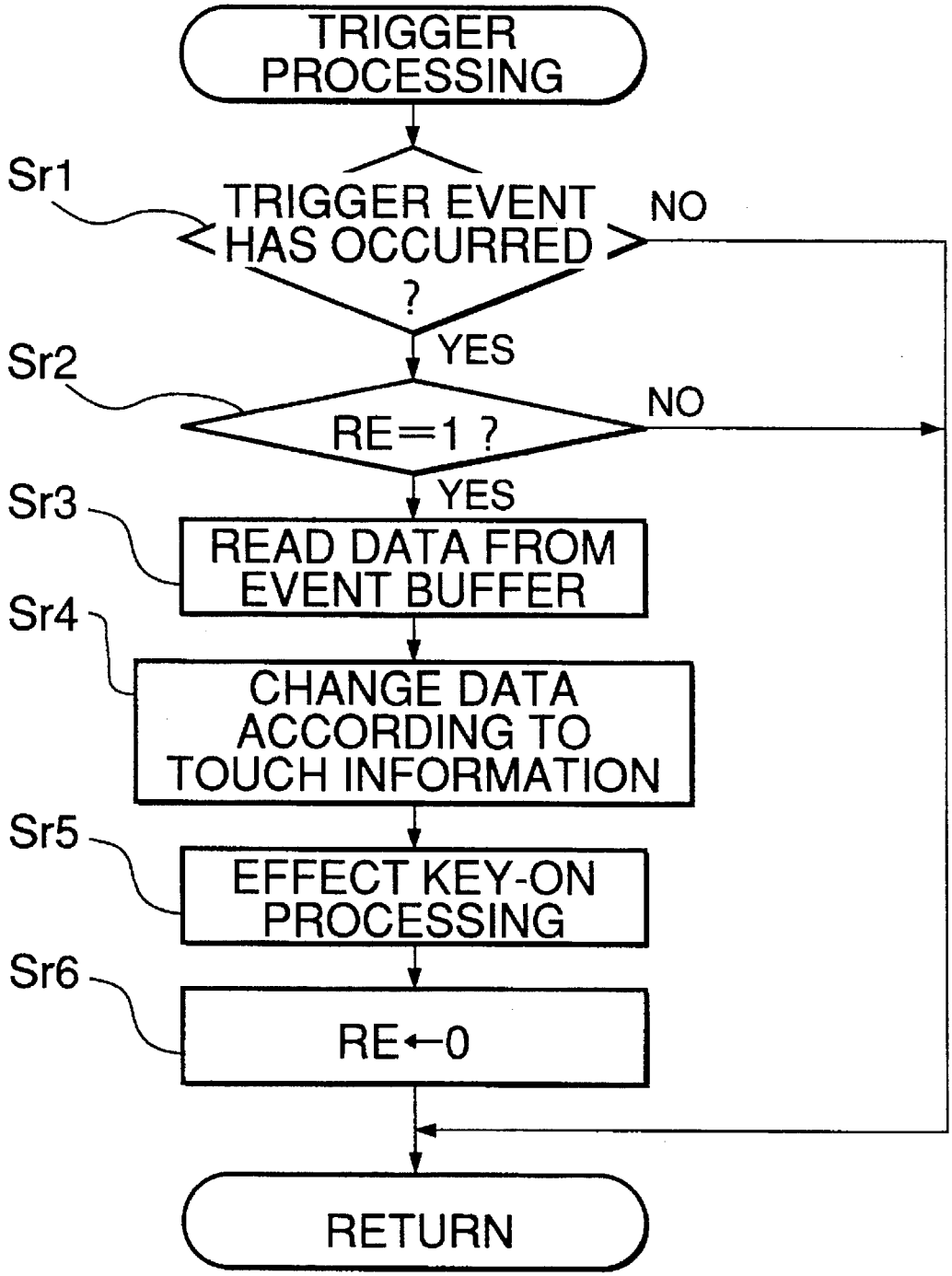

The trigger processing at the step Sm5 of the FIG. 13 main routine is carried out by calling a subroutine shown in FIG. 17 into execution. According to this subroutine, key-on data stored in the event buffer is read out in response to a trigger generated by the player, and subjected to the key-on processing.

When a trigger is generated by the player, the answer to the question of a step Sr1 as to whether a trigger event has occurred becomes affirmative (yes), and then it is determined at a step Sr2 whether or not the readout-permitting flag RE is equal to 1. If no trigger has been generated (if the answer to the question of the step Sr1 is negative (no)) or if the readout-permitting flag RE is not equal to 1 (if the answer to the question of the step Sr2 is negative (no)), the program returns to the main routine. If the answer to the question of the step Sr2 is affirmative (yes), i.e. if the readout-permitting flag RE is equal to 1, it means that key-on data has been stored in the event buffer, the data is read out at a step Sr3. Then, at a step Sr4, touch data contained in the key-on data is changed based on touch information generated together with the trigger, and the key-on processing is executed at a step Sr5 based on the key-on data including the resulting touch data to give sound-generating instructions to the tone generator 7. Thereafter, the readout-permitting flag RE is set to 0 at a step Sr6 to prevent the steps Sr3 to Sr5 from being executed until new key-on data is stored into the event buffer, followed by returning to the main routine. The step Sr6 makes it possible to prevent the same key-on data from being repeatedly read out when chattering occurs in the trigger generator 1, or the player has erroneously generated several triggers within a short time period.

According to the second embodiment, key-on data alone is retrieved in precedence to the other data, to rewrite the event buffer. Therefore, even if the player interrupts triggering, and then resumes it shortly thereafter, key-on data corresponding to the point of progress of the normal track is read out from the event buffer, which makes it possible to enjoy the optimum concert. Further, the event data other than the key-on data are processed in the same manner as data on the normal track, whereby the key-off processing, the tone color-changing processing and the like are executed irrespective of whether a trigger has been generated or not, which makes it possible to avoid inconveniences of incapability of attenuation of musical tones generated, incapability of changing the tone color, and the like.

Next, a third embodiment of the invention will be described with reference to FIG. 20 to FIG. 26. In the third embodiment, data for the trigger-driven automatic performance is divided into a plurality of phrases, and one phrase is processed for generation of musical tones per one trigger generated by the player. Although one of the normal tracks is selected for use as the trigger-driven track in the first and second embodiments described above, a track for exclusive use as the trigger-driven track is provided in the third embodiment. A data format for the track for exclusive use as the trigger-driven performance is formed, as shown in FIG. 20, by a sequence of phrase number data Ph1, duration data D1, readout-inhibiting data NR, duration data D2, phrase number data PH2, . . .

In the present embodiment, a time period corresponding to duration indicated by duration data from a time point of reading the phrase number data to a time point of reading the readout-inhibiting data NR corresponds to a trigger-accepting time period, and a time period corresponding to duration indicated by the duration data from the time point of reading the readout-inhibiting data to a time point of reading the following phrase number data corresponds to a trigger-rejecting time period.

Figures 20, 21, 22:
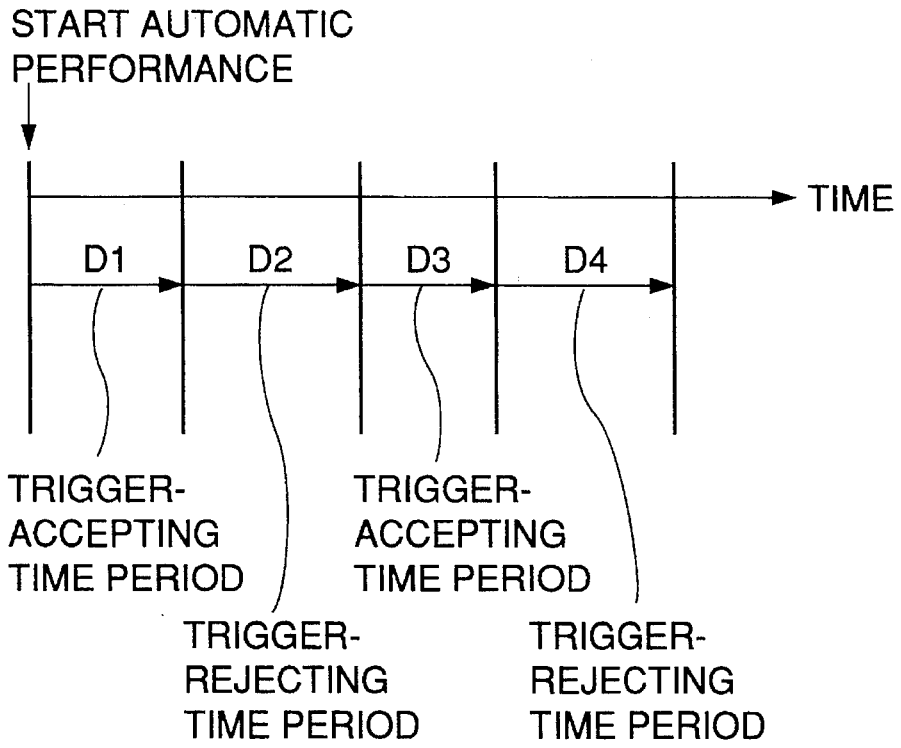
FIG. 20 shows a data format of data stored on an exclusive trigger-driven track of the third embodiment.
FIG. 21 is a diagram showing a manner of alternate occurrence of a trigger-accepting time period and a trigger-rejecting time period according to the third embodiment.
FIG. 22 shows a data format of phrase data to be stored on the exclusive trigger-driven track.

More specifically, as shown in FIG. 21, a time period corresponding to the first duration data D1 after the start of the automatic performance corresponds to a trigger-accepting time period. If a trigger is generated by the player during the trigger-accepting time period, the CPU 3 gives instructions to start reading automatic performance data of a phrase 1 (Ph1).

A time period indicated by the duration data D2 in FIG. 21 is a trigger-rejecting time period. If the point of progress of the automatic performance based on the normal tracks falls within this period, no trigger is accepted. During this time period, the readout-inhibiting data NR is held in the event buffer.

Then, a time period of duration data D3 starts, and if a trigger is generated within this time period, the CPU 3 gives instructions to start automatic performance of a phrase 2 (Ph2). Thus, after the start of the automatic performance is instructed, the trigger-accepting time period and the trigger-rejecting time period alternately occur at intervals of time periods corresponding to duration data D1, D2, D3, D4, . . . , respectively.

Automatic performance data of each phrase can be regarded as one of a plurality of divided sections of the whole automatic performance data on the normal track, and stored in the ROM 4 as shown in FIG. 22. Since the phrases are divided at points suitable for division of performance, and hence they may not be identical to each other in duration of performance thereof. The automatic performance processing per se of each phrase is similar to that of the normal track. The automatic performance of each phrase stops when data EOF indicative of the end of the phrase is read.

The operation of the third embodiment will be described with reference to FIG. 23 to FIG. 26. The FIG. 13 main routine of the second embodiment described above is also used as the main routine of the present embodiment. The timer interruption processing is executed by the FIG. 4 routine of the first embodiment, and hence description thereof is omitted. In other words, only the automatic performance processing and the trigger processing of the main routine are different from the corresponding portions (the steps Sm4 and Sm5) of the first and second embodiments, and hence description will be made of these processings with reference to FIG. 23 to FIG. 26.

Figure 23:
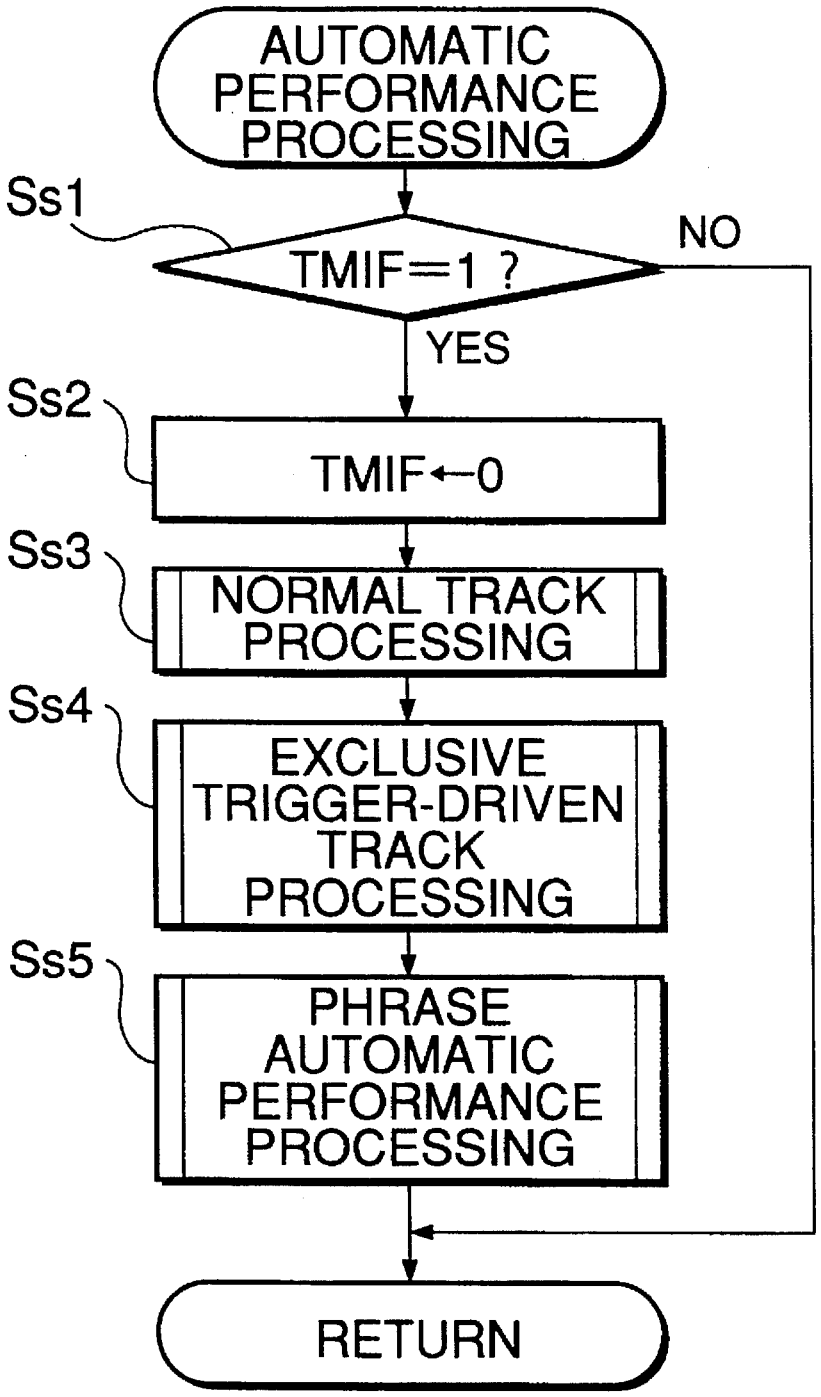

The automatic performance at the step Sm4 of the FIG. 13 main routine is carried out according to a subroutine shown in FIG. 23. This subroutine carries out the normal track processing, processing for storing the phrase number data or the readout-inhibiting data NR into the event buffer, and phrase automatic performance processing.

At a step Ss1 of the FIG. 23 subroutine, it is determined whether or not the timer interruption flag TMIF is equal to 1. If the answer to this question is affirmative (yes), the timer interruption flag TMIF is set to 0 at a step Ss2, and then the normal track processing is executed at a step Ss3. The normal track processing is effected based on the tracks which are not under trigger-driven control. The processing of the track for exclusive use for trigger-driven automatic performance is executed at a step Ss4, according to a subroutine shown in FIG. 24. The FIG. 24 subroutine carries out the processing for storing the phrase number data into the event buffer when the point of progress of the performance falls within a trigger-accepting time period, and the processing for storing the readout-inhibiting data NR into the event buffer when the point of progress of the performance falls within a trigger-rejecting time period. Further, display processing or the like is performed to inform the player via the display 11 that the trigger-accepting time period or the trigger-rejecting time period has come.

Figure 24:
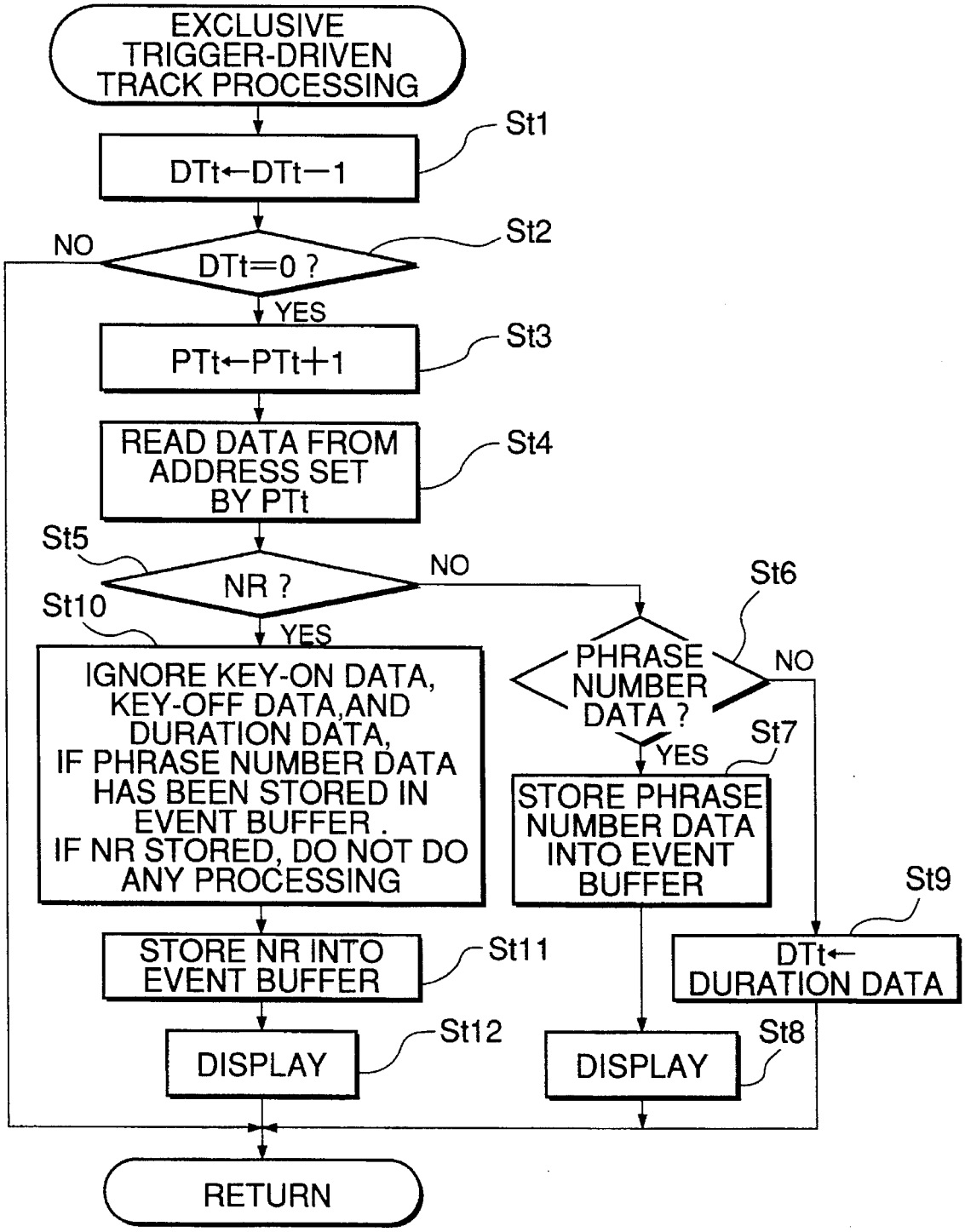

At a step St1 of the FIG. 24 subroutine, the value to be set to the duration data register DT1 is decreased by a decremental value of 1, and then it is determined at a step St2 whether or not the resulting register value is equal to 0. If the answer to this question is affirmative (yes), the pointer PTt is advanced by 1 at a step St3, and data is read at a step St4 from the read address pointed to by the pointer PTt. Then, it is determined at a step St5 whether or not the read data is readout-inhibiting data NR. If the answer to this question is affirmative (yes), the program proceeds to a step St10. At the step St10, if the phrase number data has been stored in the event buffer, key-on data, key-of data, and duration data of the automatic performance data corresponding to the phrase number are ignored, but only instructions concerning the change of tone color and the like are executed. Then, the readout-inhibiting data NR is stored into the event buffer at a step St11, and at a step St12, the display processing or the like is performed to inform the player that the trigger-rejecting time period has come, followed by returning to the automatic performance routine of FIG. 23.

If the answer to the question of the step St2 is negative (no), the program returns to the FIG. 23 subroutine.

If it is determined at the step St5 that the data read at the step St4 is not readout-inhibiting data NR, it is further determined at a step St6 whether or not the read data is phrase number data. If the answer to this question is affirmative (yes), i.e. if the data read is phrase number data, the phrase number data is stored into the event buffer at a step St7. Then, display is made at a step St8 to inform the player that the trigger-accepting time period has come, followed by returning to the main routine.

If the answer to the question of the step St7 is negative (no), it means that the read data is duration data, and hence the duration data is stored into the register DTt at a step St9, followed by returning to the FIG. 23 subroutine.

Figure 25:
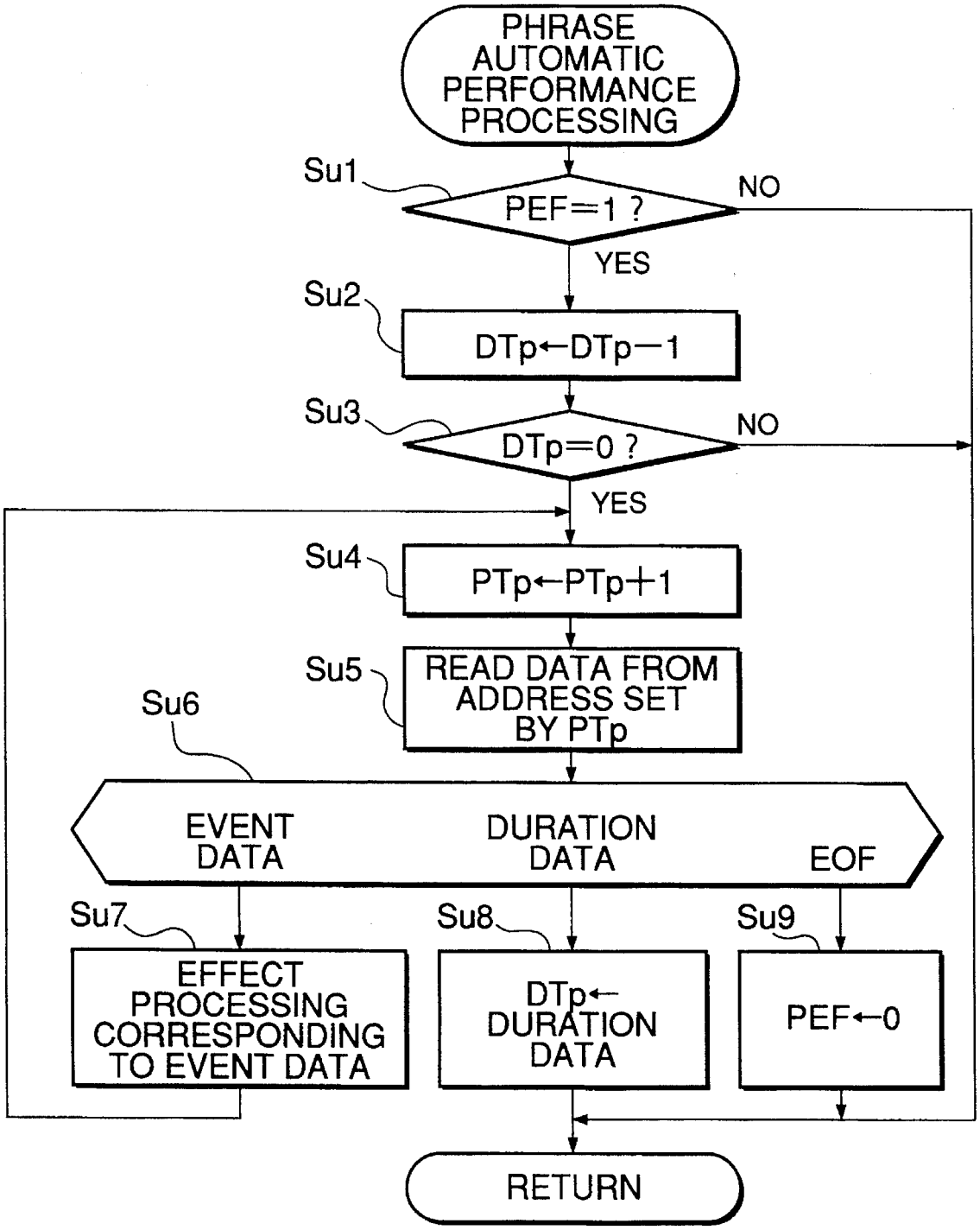

The phrase automatic performance processing is carried out at a step Ss5 of the FIG. 23 automatic performance processing subroutine, according to a subroutine shown in FIG. 25. The subroutine executes the automatic performance processing on each phrase. This processing per se is essentially identical to the automatic performance processing of the normal tracks described previously. At a step Su1 of the FIG. 25 subroutine, it is determined whether or not a flag PEF is equal to 1 indicative of the state in which a phrase being processed for generating musical tones in response to a trigger. If the answer to this question is negative (no), the program immediately returns to the FIG. 23 automatic performance processing subroutine. If the answer to this question is affirmative (yes), the value DTp to be set to the duration register DTp is decreased by a decremental value of 1 at a step Su2, and it is determined at a step Su3 whether or not the resulting register value of the data set to the duration register DTp is equal to 0. If the answer to the question of the step Su3 is negative (no), the program returns to the FIG. 23 automatic performance processing, whereas if the answer is affirmative (yes), the pointer PTp is advanced by 1 at a step Su4, and data is read from an address of the trigger-driven track, pointed to by the pointer PTp, at a step Su5. It is then determined at a step Su6 which of event data, duration data, and EOF data indicative of the end of the file, the read data is. Depending on the result of this determination, one of three kinds of processing is selected. More specifically, if the data is event data, the processing on the event data is executed at a step Su7, followed by returning to the step Su4. If the data is duration data, the event data is stored into the duration register DTp at a step Su8, followed by returning to the automatic performance processing subroutine. Further, if the data is EOF data, the flag PEF is set to 0 at a step Su9, followed by returning to the automatic performance processing subroutine.

Figure 26:
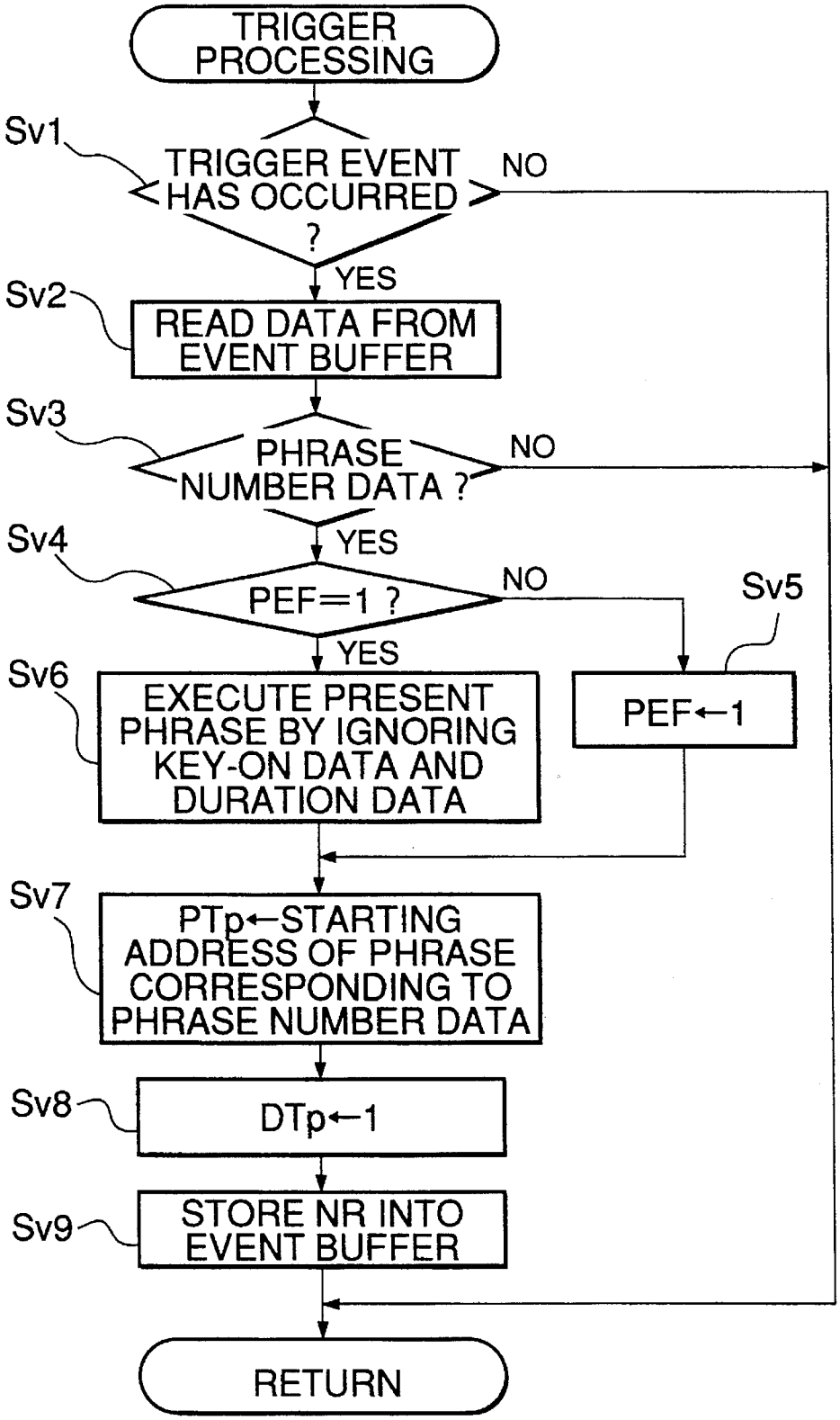

The trigger processing at the step Sm5 of the FIG. 13 main routine is executed according to a subroutine shown in FIG. 26. According to the subroutine, when a trigger has been generated, data of a phrase number is read from the event buffer, and processing, such as setting of an address corresponding to the phrase number, is carried out.

At a step Sv1 of the FIG. 26 subroutine, it is determined whether or not a trigger has been generated. If the answer to this question is negative (no), the program returns to the main routine. If the answer is affirmative (yes), data is read from the event buffer at a step Sv2, and it is determined at a step Sv3 whether or not the read data is phrase number data. If the answer to this question is negative (no), the program returns to the main routine, whereas if the answer is affirmative (yes), it is determined at a step Sv4 whether or not the flag PEF is equal to 1. If the answer to this question is affirmative (yes), it means that a trigger has been generated during generation of musical tones of a phrase, and accordingly, the key-on data and the duration data are ignored at a step Sv6 to promptly terminate the phrase in process, followed by the program proceeding to a step Sv7. If the answer to the question of the step Sv4 is negative (no), the flag PEF is set to 1 at a step Sv5, followed by the program proceeding to the step Sv7. At the step Sv7, the pointer PTp is set to the starting address of a phrase corresponding to the phrase number data of which has been read at the step Sv2, and then the duration register DTp is reset to an initial value of 1 at a step Sv8. Then, the readout-inhibiting data NR is stored into the event buffer at a step Sv9, to thereby prevent the steps Sv4 to Sv9 from being carried out a plurality of times when more than one trigger has been generated during one trigger-accepting time period, followed by returning to the main routine.

The third embodiment is advantageous in that since the trigger-accepting time period is set in advance, the processing is simpler than that executed by the first embodiment or the second embodiment.

Further, since the trigger-accepting period is indicated on the display, the player is only required to generate a trigger at timing of a large beat after the trigger-accepting period has come, which facilitates giving performance.

Many variations can be made to the embodiments described above, as follows, for example:

Although, in each of the embodiments, one of a plurality of performance parts (or tracks) is set as a trigger-driven track, this is not limitative, but a plurality of trigger generators may be provided to generate triggers for driving a plurality of trigger-driven tracks, respectively, so as to permit a plurality of players to enjoy concert.

Further, in the above embodiments, a device for storing timing of generation of the trigger event and reproducing the trigger event at the stored timing may be additionally provided, to thereby enable the player to audibly recognize a degree of deviation in timing of his performance from the performance based on the normal track. Further, a musical score may be indicated on the display to show the timing of triggering effected in the score, which enables the player to visually recognize a degree of deviation in timing of his performance from the proper timing.

Although, in the third embodiment, the trigger-accepting time period alone is displayed, a musical score may be additionally displayed to indicate timing of triggering to be effected, which enables even a beginner to give performance with ease.

Although in the first embodiment, the unit of music for reproduction in response to a trigger is a measure, this is not limitative, but it may be half of a measure, a third of a measure, two measures, etc. Further, it may be selected from these examples.

Although, in the second embodiment, the key-on data alone is stored into the event buffer, this is not limitative, but a set of key-on data, duration data therefor, and key-off data may be stored thereinto.

What is claimed is:

1. An automatic performance device comprising:

phrase storage means for storing a plurality of phrases of a musical piece as automatic performance data;

a data-storing track having a data format formed by a repetitive sequence of phrase number data indicative of a sequence of reading said phrases, duration data, and readout-inhibiting data indicative of rejection of a trigger signal;

trigger signal-generating means for generating said trigger signal;

temporary storage means for temporarily storing said phrase number data and said readout-inhibiting data; and control means for reading out said phrase number data, said duration data and said readout-inhibiting data from said track according to a predetermined tempo, and for temporarily storing one of said phrase number data and said readout-inhibiting data into said temporary storage means, and for reading out said one of said phrase number data and said readout-inhibiting data from said temporary storage means in response to said trigger signal;

wherein said control means reads out a phrase corresponding to said phrase number data from said phrase storage means if the data read out from said temporary storage means is said phrase number data, and wherein said control means inhibits processing of said automatic performance data if said data read out from said temporary storage means is said readout-inhibiting data.

2. An automatic performance device according to claim 1, wherein said duration data determines a trigger-accepting time period for permitting performance of a corresponding one of said phrases in response to said trigger signal if said duration data corresponds to a predetermined sequence between said phrase number data and said readout-inhibiting data following said phrase number data, and said duration data determines timing for initiating readout of said corresponding one of said phrases for automatic performance thereof.

3. An automatic performance device according to claim 2, further comprising display means for displaying said trigger-accepting time period.

4. An automatic performance device according to claim 1, wherein said plurality of phrases of said musical piece correspond to at least one of a plurality of parts of said musical piece.

5. An automatic performance device according to claim 4, further comprising storage means for storing automatic performance data corresponding to a plurality of parts of said musical piece other than said plurality of phrases of said musical piece, and wherein said control means reads out said automatic performance data corresponding to said other parts of said musical piece from said storage means in accordance with a predetermined tempo.

6. An automatic performance device comprising:

storage means for storing automatic performance data comprising a first portion corresponding to at least one first part of a musical piece, and a second portion corresponding to at least one second part of said musical piece, said second portion being divided into a plurality of sections each having a starting point;

first performance means for reading out said first portion of said automatic performance data from said storage means according to a predetermined tempo and for generating a musical tone based on said first portion of said automatic performance data read out;

trigger signal-generating means for generating a trigger signal according to operation of an operator;

second performance means for reading out said second portion of said automatic performance data from said storage means and for generating a musical tone based on said second portion of said automatic performance data read out; and control means for shifting a location in said storage means from which said second portion of said automatic performance data is to be read out, said location being shifted according to said predetermined tempo corresponding to said first portion of said automatic performance data;

wherein said second performance means is responsive to said trigger signal for reading out said second portion of said automatic performance data by starting reading out the starting point of one of said sections corresponding to a location in said storage means from which said first performance means reads out said first portion of said automatic performance data at the time said trigger signal is generated, to thereby generate a musical tone based on said second portion of said automatic performance data read out.

7. An automatic performance device according to claim 6, wherein said second performance means include trigger-accepting time period-setting means for setting a trigger-accepting time period for accepting said trigger signal, said second performance means reading out said second portion of said automatic performance data if said trigger signal is generated during said trigger-accepting time period.

8. An automatic performance device according to claim 7, wherein said second performance means includes trigger-rejecting means for rejecting said trigger signal which is subsequently generated during said trigger-accepting time period, once said trigger signal has been generated during said trigger-accepting time period.

9. An automatic performance device according to claim 7, wherein said second automatic performance means includes performance-stopping means responsive to said trigger signal, for stopping generating a musical tone based on said second portion of said automatic performance data if said trigger signal is generated during said trigger-accepting time period while a musical tone is being generated based on said second portion of said automatic performance data read out in response to said trigger signal which was generated during a preceding trigger accepting time period.

10. An automatic performance device according to claim 7, wherein said plurality of sections each correspond to a measure, and said trigger-accepting time period corresponds to a predetermined duration including a measure line of said measure.

11. An automatic performance device according to claim 7, wherein said plurality of sections each correspond to a predetermined phrase, and said trigger-accepting time period corresponds to a predetermined duration including timing of starting generating a musical tone based on said predetermined phrase.

12. An automatic performance device according to claim 7, further including display means for displaying said trigger-accepting time period.

13. An automatic performance device according to claim 6, wherein said at least one second part of said musical piece is arbitrarily selected from a plurality of parts of said musical piece stored in said storage means.

14. An automatic performance device according to claim 6, wherein said trigger signal-generating means comprises an analog musical instrument.

15. An automatic performance device according to claim 6, wherein said trigger signal-generating means comprises an electronic musical instrument.

16. An automatic performance device according to claim 6, wherein said second performance means includes shifting means operable upon initiation of said trigger-accepting time period to shift a location in said storage means from which said second portion of said automatic performance data is to be read out to a starting point of said measure included within said trigger-accepting time period when no trigger signal was generated during a preceding trigger-accepting time period.

17. An automatic performance device according to claim 11, wherein said second portion of said automatic performance data comprises a plurality of phrases of said musical piece and performance-sequence data having phrase number data indicative of a sequence of reading said phrases and timing data indicative of performance start timing corresponding to each said phrase, said second performance means reading out said performance-sequence data according to said predetermined tempo, said second performance means being responsive to said trigger signal for reading out one of said phrases which is indicated by said phrase number data readout at the time said trigger signal is generated.

18. An automatic performance device according to claim 17, wherein said performance-sequence data includes read-out-inhibiting data indicative of rejection of said trigger signal, said second performance means inhibiting reading out said phrases when said trigger signal is generated while reading out said readout-inhibiting data.

19. An automatic performance device comprising:

storage means for storing automatic performance data comprising a first portion corresponding to at least one first part of a musical piece, and a second portion corresponding to at least one second part of said musical piece;

first performance means for reading out said first portion of said automatic performance data from said storage means according to a predetermined tempo and for generating a musical tone based on said first portion of said automatic performance data read out;

trigger signal-generating means for generating a trigger signal according to operation of an operator;

second performance means for reading out said second portion of said automatic performance data from said storage means and for generating a musical tone based on said second portion of said automatic performance data read out; and control means for shifting a location in said storage means from which said second portion of said automatic performance data is to be read out, said location being shifted according to said predetermined tempo corresponding to said first portion of said automatic performance data;

wherein said second performance means is responsive to said trigger signal, for starting reading out said second portion of said automatic performance data indicative of a musical note corresponding to a location in said storage means from which said first performance means reads out said first portion of said automatic performance data at the time said trigger signal is generated to thereby generate a musical tone based on said second portion of said automatic performance data read out.

20. An automatic performance device according to claim 19, wherein said second performance means includes trigger-accepting time period-setting means for setting a trigger-accepting time period for accepting said trigger signal, said second performance means reading out said second portion of said automatic performance data if said trigger signal is generated during said trigger-accepting time period.

21. An automatic performance device according to claim 20, wherein said second performance means includes trigger-rejecting means for rejecting said trigger signal which is subsequently generated during said trigger-accepting time period, once said trigger signal has been generated during said trigger-accepting time period.

22. An automatic performance device according to claim 20, wherein said trigger-accepting time period corresponds to a time period of each said musical note of said second portion of said automatic performance data, and wherein said trigger-accepting time period precedes a timing of reading out of said second portion of said automatic performance data by a predetermined time period.

23. An automatic performance device according to claim 19, wherein said at least one second part of said musical piece is arbitrarily selected from a plurality of parts of said musical piece stored in said storage means.

24. An automatic performance device according to claim 19, wherein said trigger signal-generating means comprises an analog musical instrument.

25. An automatic performance device according to claim 19, wherein said trigger signal-generating means comprises an electronic musical instrument.

* * * * *